US009077084B2

(12) United States Patent
Li et al.

(10) Patent No.: US 9,077,084 B2
(45) Date of Patent: Jul. 7, 2015

(54) MULTI-BAND MULTI-ANTENNA SYSTEM AND COMMUNICATION DEVICE THEREOF

(75) Inventors: Wei-Yu Li, Yilan County (TW); Wei-Ji Chen, Tainan (TW); Chun-Yih Wu, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 238 days.

(21) Appl. No.: 13/528,853

(22) Filed: Jun. 21, 2012

(65) Prior Publication Data

US 2013/0257674 A1 Oct. 3, 2013

(30) Foreign Application Priority Data

Apr. 3, 2012 (TW) ..... 101111861 A

(51) Int. Cl.
*H01Q 21/28* (2006.01)
*H01Q 9/42* (2006.01)
(Continued)

(52) U.S. Cl.
CPC ..... *H01Q 21/28* (2013.01); *H01Q 9/42* (2013.01); *H01Q 5/321* (2015.01); *H01Q 5/378* (2015.01); *H01Q 5/40* (2015.01)

(58) Field of Classification Search
CPC ..... H01Q 1/38; H01Q 3/26; H01Q 3/2617; H01Q 9/0407; H01Q 5/321; H01Q 5/378; H01Q 5/40; H01Q 9/42; H01Q 21/28
USPC ..... 343/700 MS, 846, 853
See application file for complete search history.

(56) References Cited

U.S. PATENT DOCUMENTS 4,460,899 A 7/1984 Schmidt et al.
5,952,983 A 9/1999 Dearnley et al.
(Continued)

FOREIGN PATENT DOCUMENTS

JP 2004-274267 9/2004
JP 2004-363848 12/2004
(Continued)

OTHER PUBLICATIONS

Chen et al., "A Decoupling Technique for Increasing the Port Isolation Between Two Strongly Coupled Antennas," IEEE Transactions on Antennas and Propagation 56 (12), Dec. 2008, pp. 3650-3658.
(Continued)

*Primary Examiner* — Robert Karacsony
*Assistant Examiner* — Daniel J Munoz
(74) *Attorney, Agent, or Firm* — Jianq Chyun IP Office

(57) ABSTRACT

A multi-band multi-antenna system and a communication device thereof are provided. The multi-band multi-antenna system includes at least one ground, two antenna units, a coupling conductor line and a grounding conductor line. Both of the two antenna units have at least one conductor portion, a low-pass filtering portion and an extending conductor portion. Each antenna unit generates at least one higher and lower operating bands. The low-pass filtering portion is electrically coupled between the conductor portion and the extending conductor portion, and effectively decreases dependent relationship between the higher and lower operating bands. The coupling conductor line is disposed nearby the two antenna units and has a first coupling portion and a second coupling portion. The grounding conductor line is disposed between the two antenna units and connected to the ground.

21 Claims, 11 Drawing Sheets

(51) Int. Cl.

| | |
|---|---|
| ***H01Q 5/00*** | (2006.01) |
| ***H01Q 5/321*** | (2015.01) |
| ***H01Q 5/378*** | (2015.01) |
| ***H01Q 5/40*** | (2015.01) |

(56) References Cited

U.S. PATENT DOCUMENTS

| | | | | |
|---|---|---|---|---|
| 5,990,838 | A | 11/1999 | Burns et al. | |
| 6,104,348 | A | 8/2000 | Karlsson et al. | |
| 6,288,679 | B1 | 9/2001 | Fischer et al. | |
| 6,344,829 | B1 | 2/2002 | Lee | |
| 6,426,723 | B1 | 7/2002 | Smith et al. | |
| 6,459,413 | B1 | 10/2002 | Tseng et al. | |
| 6,549,170 | B1 | 4/2003 | Kuo et al. | |
| 6,583,765 | B1 | 6/2003 | Schamberger et al. | |
| 6,624,789 | B1 | 9/2003 | Kangasvieri et al. | |
| 6,624,790 | B1 | 9/2003 | Wong et al. | |
| 6,788,257 | B2 | 9/2004 | Fang et al. | |
| 6,909,401 | B2 | 6/2005 | Rutfors et al. | |
| 7,271,777 | B2 | 9/2007 | Yuanzhu | |
| 7,289,068 | B2 * | 10/2007 | Fujio et al. | 343/700 MS |
| 7,330,156 | B2 | 2/2008 | Arkko et al. | |
| 7,352,328 | B2 | 4/2008 | Moon et al. | |
| 7,385,563 | B2 | 6/2008 | Bishop | |
| 7,405,699 | B2 | 7/2008 | Qin | |
| 7,460,069 | B2 | 12/2008 | Park et al. | |
| 7,498,997 | B2 | 3/2009 | Moon et al. | |
| 7,541,988 | B2 | 6/2009 | Sanelli et al. | |
| 7,551,144 | B2 | 6/2009 | Manholm et al. | |
| 7,561,110 | B2 | 7/2009 | Chen | |
| 7,573,433 | B2 | 8/2009 | Qin | |
| 7,586,445 | B2 | 9/2009 | Qin et al. | |
| 7,609,221 | B2 | 10/2009 | Chung et al. | |
| 7,688,273 | B2 | 3/2010 | Montgomery et al. | |
| 7,710,343 | B2 | 5/2010 | Chiu et al. | |
| 7,714,789 | B2 | 5/2010 | Tsai et al. | |
| 7,733,285 | B2 | 6/2010 | Gainey et al. | |
| 7,764,233 | B2 | 7/2010 | Wu | |
| 7,808,438 | B2 | 10/2010 | Schlub et al. | |
| 7,825,864 | B2 | 11/2010 | Li et al. | |
| 7,834,809 | B2 | 11/2010 | Tseng et al. | |
| 7,956,811 | B2 | 6/2011 | Huang | |
| 7,973,726 | B2 | 7/2011 | Tseng et al. | |
| 2004/0257291 | A1 * | 12/2004 | Man et al. | 343/795 |
| 2007/0236400 | A1 * | 10/2007 | Rentz | 343/753 |
| 2007/0257842 | A1 | 11/2007 | Tseng | |
| 2008/0258992 | A1 * | 10/2008 | Tsai et al. | 343/853 |
| 2009/0213021 | A1 | 8/2009 | Yun et al. | |
| 2009/0322639 | A1 | 12/2009 | Lai | |
| 2010/0093282 | A1 | 4/2010 | Martikkala et al. | |
| 2010/0123639 | A1 | 5/2010 | Tai et al. | |
| 2010/0134377 | A1 | 6/2010 | Tsai et al. | |
| 2010/0156726 | A1 | 6/2010 | Montgomery et al. | |
| 2010/0156745 | A1 | 6/2010 | Andrenko et al. | |
| 2010/0156747 | A1 | 6/2010 | Montgomery | |
| 2010/0238079 | A1 | 9/2010 | Ayatollahi et al. | |
| 2010/0295736 | A1 | 11/2010 | Su | |
| 2010/0295750 | A1 | 11/2010 | See et al. | |
| 2011/0019723 | A1 | 1/2011 | Lerner et al. | |
| 2011/0102281 | A1 | 5/2011 | Su | |
| 2011/0122040 | A1 * | 5/2011 | Wakabayashi | 343/833 |
| 2011/0128206 | A1 | 6/2011 | Wakabayashi | |
| 2011/0148736 | A1 | 6/2011 | Choi et al. | |
| 2012/0013519 | A1 * | 1/2012 | Hakansson et al. | 343/835 |
| 2012/0212389 | A1 * | 8/2012 | Aizawa et al. | 343/853 |
| 2012/0274536 | A1 * | 11/2012 | Pan | 343/853 |
| 2013/0162496 | A1 * | 6/2013 | Wakabayashi | 343/853 |

FOREIGN PATENT DOCUMENTS

| | | | |
|---|---|---|---|
| JP | 2005-086780 | 3/2005 | |
| JP | 2008-199588 | 8/2008 | |
| JP | 2011-282843 | * 12/2011 | H01Q 1/52 |
| JP | 2012-231417 | 11/2012 | |
| TW | M380590 | 5/2010 | |
| WO | 2013015264 | 1/2013 | |

OTHER PUBLICATIONS

Cal et al., "A Novel Wideband Diversity Antenna for Mobile Handsets," Microwave and Optical Technology Letters 51 (1), Jan. 2009, pp. 218-222.

Choi et al., "Performance Evaluation of 2×2 MIMO Handset Antenna Arrays for Mobile WiMAX Applications," Microwave and Optical Technology Letters 51 (6), Jun. 2009, pp. 1558-1561.

Kang et al., "Isolation Improvement of 2.4/5.2/5.8 GHz WLAN Internal Laptop Computer Antennas Using Dual-Band Strip Resonator as a Wavetrap," Microwave and Optical Technology Letters 52 (1), Jan. 2010, pp. 58-64.

Su, "Concurrent Dual-Band Six-Loop-Antenna System With Wide 3-dB Beamwidth Radiation for MIMO Access Points," Microwave and Optical Technology Letters 52 (6), Jun. 2010, pp. 1253-1258.

Bae et al., "Compact Mobile Handset MIMO Antenna for LTE700 Applications," Microwave and Optical Technology Letters 52 (11), Nov. 2010, pp. 2419-2422.

Han et al., "MIMO Antenna Using a Decoupling Network for 4G USB Dongle Application," Microwave and Optical Technology Letters 52 (11), Nov. 2010, pp. 2551-2554.

Kim et al., "Design of a Dual-Band MIMO Antenna for Mobile WiMAX Application," Microwave and Optical Technology Letters 53 (2), Feb. 2011, pp. 410-414.

Coetzee et al., "Compact Multiport Antenna With Isolated Ports," Microwave and Optical Technology Letters 50 (1), Jan. 2006, pp. 229-232.

Ding et al., "A Novel Dual-Band Printed Diversity Antenna for Mobile Terminals," IEEE Transactions on Antennas and Propagation 55 (7), Jul. 2007, pp. 2088-2096.

Liu et al., "A Compact Wideband Planar Diversity Antenna for Mobile Handsets," Microwave and Optical Technology Letters 50 (1), Jan. 2008, pp. 87-91.

Chou et al., "Internal Wideband Monopole Antenna for MIMO Access-Point Applications in the WLAN/WIMAZ Bands," Microwave and Optical Technology Letters 50 (5), May 2008, pp. 1146-1148.

Su et al., "Printed Coplanar Two-Antenna Element for 2.4/5 Ghz WLAN Operation in a MIMO System," Microwave and Optical Technology Letters 50 (6), Jun. 2008, pp. 1635-1638.

Ethier et al., "MIMO Handheld Antenna Design Approach Using Characteristic Mode Concepts,", Microwave and Optical Technology Letters 50 (7), Jul. 2008, pp. 1724-1727.

Saou-Wen Su, "A Three-In-One Diversity Antenna System for 5 Ghz WLAN Applications," Microwave and Optical Technology Letters 51 (10), Oct. 2009, pp. 2477-2481.

"Notice of Grant of Japan Counterpart Application", issued on Jan. 28, 2014, p. 1-p. 3.

* cited by examiner

MULTI-BAND MULTI-ANTENNA SYSTEM AND COMMUNICATION DEVICE THEREOF

CROSS-REFERENCE TO RELATED APPLICATION

This application claims the priority benefit of Taiwan application serial no. 101111861, filed on Apr. 3, 2012. The entirety of the above-mentioned patent application is hereby incorporated by reference herein and made a part of this specification.

BACKGROUND

1. Field of the Disclosure

The disclosure relates to a multi-antenna structure and a communication device thereof.

2. Description of Related Art

The increasing demand in signal quality, reliability and transmission speed of wireless communication signals result in multi-antenna systems being developed, for example, a pattern switchable or beam-steering antenna system or a multi-input multi-output (MIMO) antenna system. For example, the MIMO antenna technique (IEEE 802.11n) of a wireless local area network (WLAN) system band (2400-2484 MHz, 84 MHz) has been successfully applied in products such as laptops, handheld communication devices or wireless access points, and so on.

In addition to the WLAN system, a fourth generation mobile communication system (4G), for example, a long term revolution (LTE) system is also developed to be capable of achieving the MIMO multi-antenna system application. Therefore, in the future, the 4G mobile communication system can achieve greater mobile Internet capability than that of a 2G or a 3G mobile communication system. Since communication bands planned in different countries are not necessarily the same, for example, U.S.A adopts an LTE700 (704-787 MHz) band, and China and Europe respectively use an LTE2300 (2300-2400 MHz) band and an LTE2500 (2500-2690 MHz) band, and so forth. Therefore, a design challenge of the MIMO multi-antenna system is increased.

When a plurality of antennas having a same operating band are designed in a device with a limited space, if each of the antennas is required to achieve a demand of multi-band operation, problems such as multi-band decoupling may increase design complexity of the multi-antenna system.

A quarter wavelength of the 2400 MHz operating frequency of the WLAN system is about 31 mm. Therefore, the required antenna resonance size is relatively small, so that within the device, a larger space may be formed between the antennas to reduce a mutual coupling problem. However, a quarter wavelength of the 700 MHz operating frequency of the LTE700 system is about 107 mm, which is about three times greater than the quarter wavelength of the 2400 MHz operating frequency. Therefore, the antenna of the LTE700 band requires a larger resonance size for implementation, so that in the device with the limited space, a space between the antennas is shortened, which leads to increasing technical difficulty in isolation between the antennas. If an electrical connecting metal line is designed between two adjacent antennas, the isolation between the two antennas could be enhanced. However, this method is applied in single band energy decoupling rather than multi-band energy decoupling.

Another method for the single band of a shorter operating wavelength (for example, the 2400 MHz band) is designing a grounding metal structure or a slot the portions of a ground between two adjacent antennas to increase the isolation of them. However, the grounding metal structure or the slot would excite strong induced surface currents on the ground, and when the induced surface current are generated in a longer wavelength band, it may decrease the impedance matching of the two adjacent antennas.

The disclosure provides a multi-band multi-antenna system and a communication device thereof.

SUMMARY

The disclosure is directed to a multi-band multi-antenna system and a communication device thereof, which may resolve at least one of the technical problems of the related art.

The disclosure provides a multi-band multi-antenna system including a ground, a first antenna unit, a second antenna unit, a coupling conductor line and a grounding conductor line. The first antenna unit has a first conductor portion, a first low-pass filtering portion and a first extending conductor portion. The first conductor portion is electrically coupled to the ground through a first signal source, and the first low-pass filtering portion is electrically coupled between the first conductor portion and the first extending conductor portion. The first conductor portion forms a first higher band resonance path of the first antenna unit, and the first higher band resonance path generates a first higher operating band. The first conductor portion, the first low-pass filtering portion and the first extending conductor portion form a first lower band resonance path of the first antenna unit, and the first lower band resonance path generates a first lower operating band. The first higher and the first lower operating bands are respectively configured to transmit or receive electromagnetic signals of at least one communication system band. The second antenna unit has a second conductor portion, a second low-pass filtering portion and a second extending conductor portion. The second conductor portion is electrically coupled to the ground through a second signal source, and the second low-pass filtering portion is electrically coupled between the second conductor portion and the second extending conductor portion. The second conductor portion forms a second higher band resonance path of the second antenna unit, and the second higher band resonance path generates a second higher operating band. The second conductor portion, the second low-pass filtering portion and the second extending conductor portion form a second lower band resonance path of the second antenna unit, and the second lower band resonance path generates a second lower operating band. The second higher and the second lower operating bands are respectively configured to transmit or receive electromagnetic signals of at least one communication system band. The first lower and the second lower operating bands cover at least one same communication system band, and the first higher and the second higher operating bands cover at least one same communication system band. The coupling conductor line is disposed nearby the first antenna unit and the second antenna unit, and has a first coupling portion and a second coupling portion. There is a first coupling gap between first coupling portion and the first antenna unit, and there is a second coupling gap between the second coupling portion and the second antenna unit. The grounding conductor line is disposed between the first antenna unit and the second antenna unit, and is electrically connected to the ground.

The disclosure provides a communication device including a multi-band transceiver and a multi-band multi-antenna system. The multi-band transceiver is configured to serves as a signal source and is located on a ground. The multi-band multi-antenna system is electrically coupled to the multi-band transceiver, and includes a first antenna unit, a second antenna unit, a coupling conductor line and a grounding conductor line. The first antenna unit has a first conductor portion, a first low-pass filtering portion and a first extending conductor portion. The first low-pass filtering portion is electrically coupled between the first conductor portion and the first extending conductor portion, and the first conductor portion is electrically coupled to the multi-band transceiver. The first conductor portion forms a first higher band resonance path of the first antenna unit, and the first higher band resonance path generates a first higher operating band. The first conductor portion, the first low-pass filtering portion and the first extending conductor portion form a first lower band resonance path of the first antenna unit, and the first lower band resonance path generates a first lower operating band. The first higher and lower operating bands are respectively configured to transmit or receive electromagnetic signals of at least one communication system band. The second antenna unit has a second conductor portion, a second low-pass filtering portion and a second extending conductor portion. The second low-pass filtering portion is electrically coupled between the second conductor portion and the second extending conductor portion, and the second conductor portion is electrically coupled to the multi-band transceiver. The second conductor portion forms a second higher band resonance path of the second antenna unit, and the second higher band resonance path generates a second higher operating band. The second conductor portion, the second low-pass filtering portion and the second extending conductor portion form a second lower band resonance path of the second antenna unit, and the second lower band resonance path generates a second lower operating band. The second higher and the second lower operating bands are respectively configured to transmit or receive electromagnetic signals of at least one communication system band. The first lower and the second lower operating bands cover at least one same communication system band, and the first higher and the second higher operating bands cover at least one same communication system band. The coupling conductor line is disposed nearby the first antenna unit and the second antenna unit, and has a first coupling portion and a second coupling portion. There is a first coupling gap between the first coupling portion and the first antenna unit, and there is a second coupling gap between the second coupling portion and the second antenna unit. The grounding conductor line is disposed between the first antenna unit and the second antenna unit, and is electrically connected to the ground.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
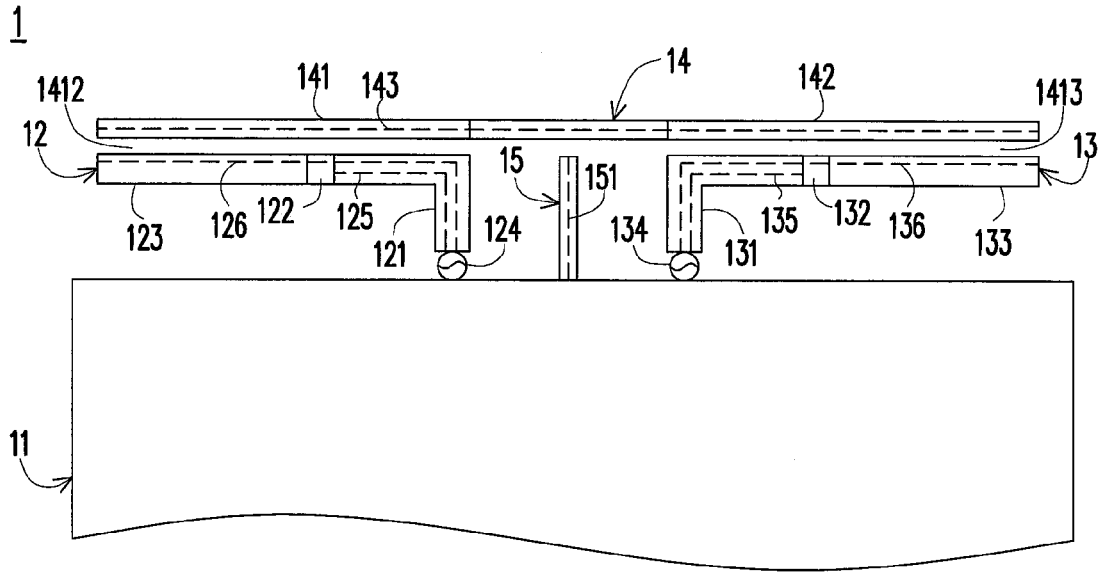
FIG. 1 is a structural schematic diagram of a multi-band multi-antenna system 1 according to an exemplary embodiment of the disclosure.

Below, exemplary embodiments will be described in detail with reference to accompanying drawings so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

The disclosure provides a plurality of exemplary embodiments illustrating multi-band multi-antenna systems and communication devices thereof. The exemplary embodiments may be applied in various communication devices, for example, a mobile communication device, a wireless communication device, a mobile computing device, a computer system, or the exemplary embodiments may be applied in telecommunication equipment, network equipment or peripheral equipment of a computer or a network.

A plurality of exemplary embodiments of the disclosure provides technical structures which may implement the multi-band multi-antenna systems. According to a commonly used design method of a multi-band antenna, a lower band resonance path thereof is used to generate a first resonant mode (a fundamental mode) to achieve an impedance bandwidth required by a lower communication band, and the higher-order modes of the fundamental mode generated by the lower band resonance path is used to achieve an impedance bandwidth required by a higher communication band. Alternatively, the higher-order modes of the fundamental mode generated by the lower band resonance path and a fundamental mode generated by another higher band resonance path are used to achieve the impedance bandwidth required by the higher communication band. In this way, the antenna is designed to achieve multi-band operations. However, such design approach generally increases a design challenge in multi-band decoupling, for example, the lower band mode and the higher band modes of the antenna would have higher dependent relationship, and a problem of energy coupling of the lower and higher band modes between different antenna units of the multi-band multi-antenna system is not easy to be suppressed.

The disclosure provides a multi-band multi-antenna system including a ground, a first antenna unit, a second antenna unit, a coupling conductor line and a grounding conductor line. The first antenna unit has a first signal source, a first conductor portion, a first low-pass filtering portion and a first extending conductor portion. The first conductor portion is electrically coupled to the ground through the first signal source. The first conductor portion forms at least one first higher band resonance path of the first antenna unit, and the first higher band resonance path generates at least one first higher operating band. The first conductor portion, the first low-pass filtering portion and the first extending conductor portion form at least one first lower band resonance path of the first antenna unit, and the first lower band resonance path generates at least one first lower operating band. The first higher and the first lower operating bands are respectively configured to transmit or receive electromagnetic signals of at least one communication system band.

The second antenna unit has a second signal source, a second conductor portion, a second low-pass filtering portion and a second extending conductor portion. The second conductor portion is electrically coupled to the ground through the second signal source. The second conductor portion forms at least one second higher band resonance path of the second antenna unit, and the second higher band resonance path generates at least one second higher operating band. The second conductor portion, the second low-pass filtering portion and the second extending conductor portion form at least one second lower band resonance path of the second antenna unit, and the second lower band resonance path generates at least one second lower operating band. The second higher and the second lower operating bands are respectively configured to transmit or receive electromagnetic signals of at least one communication system band. The first and second lower operating bands cover at least one same communication system band, and the first and second higher operating bands cover at least one same communication system band.

The low-pass filtering portion may be, for example, a chip inductor, a low-pass filtering device, a low-pass filtering circuit or a meandered thin conductor line. The low-pass filtering portion would not block the lower band resonance path of the antenna unit from exciting the first resonant mode (the fundamental mode) thereof, but would effectively suppress the higher-order modes of the fundamental mode of the lower band resonance path. Therefore, the lower operating band of the antenna unit is formed by the first resonant mode of the lower band resonance path thereof. The low-pass filtering portion could simultaneously suppress a resonance current of the higher operating band of the antenna unit from flowing through the low-pass filtering portion. Therefore, the higher operating band of the antenna unit is formed by the first resonant mode of the higher band resonance path thereof. Moreover, since the low-pass filtering portion could effectively suppress the higher-order modes of the lower band resonance path of the antenna unit, the dependent relationship of the lower and higher operating bands of the antenna unit could be effectively reduced. In this way, the complexity of multi-band decoupling problems in the multi-antenna system could be decreased. Moreover, the low-pass filtering portion could also effectively reduce a required physical length of the lower band resonance path of the antenna unit, and thus an overall size of the antenna unit could be effectively reduced, so as to achieve a larger isolation distance between the antenna units within a limited space of the communication device.

In order to effectively resolve the problem of multi-band decoupling, the coupling conductor line is designed in the multi-band multi-antenna system, which is disposed nearby the first antenna unit and the second antenna unit, and has at least one first coupling portion and at least one second coupling portion. There is a first coupling gap between the first coupling portion and the first antenna unit, and there is a second coupling gap between the second coupling portion and the second antenna unit. The first coupling gap and the second coupling gap are all smaller than a two percent wavelength of a lowest operating frequency of a lowest communication system band commonly covered by the first and the second lower operating bands. The first coupling gap may guide near field energy of the first antenna unit to the coupling conductor line, and the second coupling gap may guide near field energy of the second antenna unit to the coupling conductor line. In this way, the strength of induced surface currents generated on the ground by the coupling conductor line operated in the first lower and the second lower operating bands with a longer wavelength could be reduced, so as to reduce the interference on the resonant modes excited by the adjacent first and the second antenna units. A length of the coupling conductor line is between a ⅓ wavelength and a ¾ wavelength of a center operating frequency of the lowest communication system band commonly covered by the first and second lower operating bands. Since the first and the second low-pass filtering portions could effectively suppress the high-order modes of the first and the second lower band resonance paths respectively, the dependent relationship between the lower and the higher operating bands of the first and the second antenna units could be effectively reduced. Moreover, the lower operating bands of the first and the second antenna units are respectively formed by the first resonant mode of the lower band resonance paths thereof. Therefore, the coupling conductor line could be configured as an isolation mechanism of the lower operating bands of the first and the second antenna units, which could effectively reduce an energy coupling degree of the communication system band commonly covered by the first lower and the second lower operating bands. The coupling conductor line could effectively enhance the isolation of the lower operating bands of the first and the second antenna units.

Besides, the grounding conductor line is designed in the multi-band multi-antenna system, which is disposed between the first antenna unit and the second antenna unit, and is electrically connected to the ground. A length of the grounding conductor line is between a ⅙ wavelength and a ½ wavelength of the center operating frequency of the lowest communication system band commonly covered by the first and second higher operating bands. Since the first and the second low-pass filtering portions could respectively suppress the resonance currents of the first and the second higher operating bands from passing through the low-pass filtering portions, the higher operating bands of the first and the second antenna units are respectively formed by the first resonant mode of the first and the second higher band resonance paths. In this way, the dependent relationship between the lower and the higher operating bands of the first and the second antenna units could be effectively reduced. Therefore, the grounding conductor line could be configured as an isolation mechanism of the higher operating bands of the first and the second antenna units, which may effectively reduce an energy coupling degree of the communication system band commonly covered by the first and the second higher operating bands. The grounding conductor line could effectively enhance the isolation of the higher operating bands of the first and the second antenna units.

The multi-band multi-antenna system and the communication device provided by the disclosure are described below in accordance with FIG. 1 to FIG. 11B, and a technical solution of multi-band decoupling in the multi-band multi-antenna system are also provided.

FIG. 1 is a structural schematic diagram of a multi-band multi-antenna system 1 according to an exemplary embodiment of the disclosure. Referring to FIG. 1, the multi-band multi-antenna system 1 includes a ground 11, a first antenna unit 12, a second antenna unit 13, a coupling conductor line 14 and a grounding conductor line 15. The first antenna unit 12 has a first signal source 124, a first conductor portion 121, a first low-pass filtering portion 122 and a first extending conductor portion 123. The first conductor portion 121 is coupled to the ground 11 through the first signal source 124. The first conductor portion 121 forms a first higher band resonance path 125 of the first antenna unit 12, and the first higher band resonance path 125 generates a first higher operating band. The first conductor portion 121, the first low-pass filtering portion 122 and the first extending conductor portion 123 form a first lower band resonance path 126 of the first antenna unit 12, and the first lower band resonance path 126 generates a first lower operating band. The first higher operating band and the first lower operating band are respectively configured to transmit or receive electromagnetic signals of at least one communication system band.

The first low-pass filtering portion 122 may be, for example, a chip inductor, a low-pass filtering device, a low-pass filtering circuit or a meandered thin conductor line. The first low-pass filtering portion 122 would not interfere the first lower band resonance path 126 from exciting the first resonant mode (the fundamental mode) thereof, but would effectively suppress the higher-order modes of the fundamental mode of the first lower band resonance path 126. Therefore, the first lower operating band is formed by the first resonant mode of the first lower band resonance path 126. The first low-pass filtering portion 122 could simultaneously suppress the resonance current of the first higher operating band from flowing through the first low-pass filtering portion 122. Therefore, the first higher operating band is formed by the first resonant mode of the first higher band resonance path 125. Moreover, since the first low-pass filtering portion 122 could effectively suppress the higher-order modes of the first lower band resonance path 125, the dependent relationship of the first lower and higher operating bands could be effectively reduced. In this way, the complexity of multi-band decoupling problems in the multi-band multi-antenna system 1 could be decreased. Moreover, the first low-pass filtering portion 122 could also effectively reduce the required resonant length of the first lower band resonance path 126, so that an overall size of the first antenna unit 12 could be effectively reduced, so as to achieve a larger isolation distance between the antenna units within a limited space of the communication device.

The second antenna unit 13 has a second signal source 134, a second conductor portion 131, a second low-pass filtering portion 132 and a second extending conductor portion 133. The second conductor portion 131 is electrically coupled to the ground 11 through the second signal source 134. The second conductor portion 131 forms a second higher band resonance path 135 of the second antenna unit 13, and the second higher band resonance path 135 generates a second higher operating band. The second conductor portion 131, the second low-pass filtering portion 132 and the second extending conductor portion 133 form a second lower band resonance path 136 of the second antenna unit 13, and the second lower band resonance path 136 generates a second lower operating band. The second higher operating band and the second lower operating band are respectively configured to transmit or receive electromagnetic signals of at least one communication system band. The first and the second lower operating bands cover at least one same communication system band, and the first and second higher operating bands cover at least one same communication system band.

The second low-pass filtering portion 132 may be, for example, a chip inductor, a low-pass filtering device, a low-pass filtering circuit or a meandered thin conductor line. The second low-pass filtering portion 132 would not interfere the second lower band resonance path 136 from exciting the first resonant mode (the fundamental mode) thereof, but would effectively suppress the higher-order modes of the fundamental mode of the second lower band resonance path 136. Therefore, the second lower operating band is formed by the first resonant mode of the second lower band resonance path 136. The second low-pass filtering portion 132 could simultaneously suppress a resonance current of the second higher operating band from flowing through the second low-pass filtering portion 132. Therefore, the second higher operating band is formed by the first resonant mode of the second higher band resonance path 135. Moreover, since the second low-pass filtering portion 132 could effectively suppress the higher-order modes of the second lower band resonance path 135, the dependent relationship of the second lower and higher operating bands could be effectively reduced. In this way, the complexity of multi-band decoupling problems in the multi-band multi-antenna system 1 could be decreased. Moreover, the second low-pass filtering portion 132 could also effectively reduce a required physical length of the second lower band resonance path 136, so that an overall size of the second antenna unit 13 could be effectively reduced, so as to achieve a larger isolation distance between the antenna units within a limited space of the communication device.

The coupling conductor line 14 is disposed nearby the first antenna unit 12 and the second antenna unit 13, and has a first coupling portion 141 and a second coupling portion 142. The first coupling portion 141 and the first antenna unit 12 have a first coupling gap 1412, and the second coupling portion 142 and the second antenna unit 13 have a second coupling gap 1413. The first coupling gap 1412 and the second coupling gap 1413 are all smaller than a two percent wavelength of a lowest operating frequency of a lowest communication system band commonly covered by the first and the second lower operating bands. The first coupling gap 1412 could guide near field energy of the first antenna unit 12 to the coupling conductor line 14, and the second coupling gap 1413 could guide near field energy of the second antenna unit 13 to the coupling conductor line 14. In this way, the strength of induced surface currents on the ground generated by the coupling conductor line 14 operated in the first lower and the second lower operating bands with a longer wavelength could be effectively decreased, so as to reduce the interference on the resonant modes excited by the adjacent first antenna unit 12 and the second antenna unit 13. A length of a path 143 of the coupling conductor line 14 is between a ⅓ wavelength and a ¾ wavelength of a center operating frequency of the lowest communication system band commonly covered by the first and second lower operating bands.

Since the first low-pass filtering portion 122 and the second low-pass filtering portion 132 could effectively suppress the high-order modes of the first lower band resonance path 126 and the second lower band resonance path 136, the dependent relationship between the lower and the higher operating bands of the first antenna unit 12 and the second antenna unit 13 could be effectively reduced. Moreover, the lower operating bands of the first antenna unit 12 and the second antenna unit 13 are respectively formed by the first resonant mode of the lower band resonance paths 126 and 136 thereof. Therefore, the coupling conductor line 14 could be configured as an isolation mechanism of the lower operating bands of the first antenna unit 12 and the second antenna unit 13, which could effectively reduce an energy coupling degree of the communication system band commonly covered by the first and the second lower operating bands. The coupling conductor line 14 could effectively enhance the isolation of the lower operating bands of the first antenna unit 12 and the second antenna unit 13.

The grounding conductor line 15 is disposed between the first antenna unit 12 and the second antenna unit 13, and is electrically connected to the ground 11. A length of a path 151 of the grounding conductor line 15 is between a ⅙ wavelength and a ½ wavelength of the center operating frequency of the lowest communication system band commonly covered by the first and the second higher operating bands. Since the first low-pass filtering portion 122 and the second low-pass filtering portion 132 could respectively suppress the resonance currents of the first and the second higher operating bands from passing through the low-pass filtering portions 122 and 132, the higher operating bands of the first antenna unit 12 and the second antenna unit 13 are respectively formed by the first resonant mode of the first higher band resonance path 125 and the second higher band resonance path 135. In this way, the dependent relationship between the lower and the higher operating bands of the first antenna unit 12 and the second antenna unit 13 could be effectively reduced. Therefore, the grounding conductor line 15 could be configured as an isolation mechanism of the higher operating bands of the first antenna unit 12 and the second antenna unit 13, which could effectively reduce energy coupling degrees of the communication system bands commonly covered by the first and the second higher operating bands. The grounding conductor line 15 could effectively enhance the isolation of the higher operating bands of the first antenna unit 12 and the second antenna unit 13, so as to achieve a multi-input multi-output (MIMO), a pattern switchable, a pattern diversity or a beam-steering multi-antenna system operation.

Figure 2:
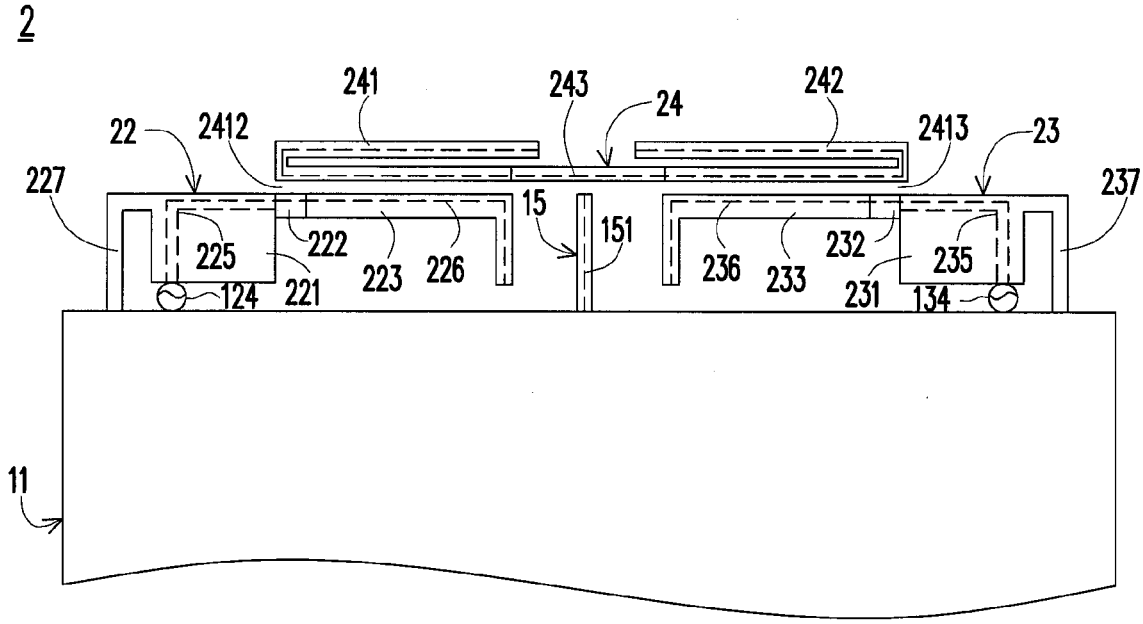
FIG. 2 is a structural schematic diagram of a multi-band multi-antenna system 2 according to an exemplary embodiment of the disclosure.

FIG. 2 is a structural schematic diagram of a multi-band multi-antenna system 2 according to an exemplary embodiment of the disclosure. Referring to FIG. 2, the multi-band multi-antenna system 2 includes the ground 11, a first antenna unit 22, a second antenna unit 23, a coupling conductor line 24 and a grounding conductor line 15. The first antenna unit 22 has the first signal source 124, a first conductor portion 221, a first low-pass filtering portion 222 and a first extending conductor portion 223. The first conductor portion 221 is electrically coupled to the ground 11 through the first signal source 124. The first conductor portion 221 has a short-circuit portion 227 electrically coupled to the ground 11. The short-circuit portion 227 is configured to adjust impedance matching of the resonance modes of the first antenna unit 22. The first conductor portion 221 forms a first higher band resonance path 225 of the first antenna unit 22, and the first higher band resonance path 225 generates a first higher operating band. The first conductor portion 221, the first low-pass filtering portion 222 and the first extending conductor portion 223 form a first lower band resonance path 226 of the first antenna unit 22, and the first lower band resonance path 226 generates a first lower operating band. The first higher operating band and the first lower operating band are respectively configured to transmit or receive electromagnetic signals of at least one communication system band. The first low-pass filtering portion 222 may be, for example, a chip inductor, a low-pass filtering device, a low-pass filtering circuit or a meandered thin conductor line.

The second antenna unit 23 has the second signal source 134, a second conductor portion 231, a second low-pass filtering portion 232 and a second extending conductor portion 233. The second conductor portion 231 is electrically coupled to the ground 11 through the second signal source 134. The second conductor portion 231 has a short-circuit portion 237 electrically coupled to the ground 11. The short-circuit portion 237 is configured to adjust impedance matching of the resonance modes of the second antenna unit 23. The second conductor portion 231 forms a second higher band resonance path 235 of the second antenna unit 23, and the second higher band resonance path 235 generates a second higher operating band. The second conductor portion 231, the second low-pass filtering portion 232 and the second extending conductor portion 233 form a second lower band resonance path 236 of the second antenna unit 23, and the second lower band resonance path 236 generates a second lower operating band. The second higher operating band and the second lower operating band are respectively configured to transmit or receive electromagnetic signals of at least one communication system band. The first and second lower operating bands cover at least one same communication system band, and the first and the second higher operating bands cover at least one same communication system band. The second low-pass filtering portion 232 may be, for example, a chip inductor, a low-pass filtering device, a low-pass filtering circuit or a meandered thin conductor line.

The coupling conductor line 24 is disposed nearby the first antenna unit 22 and the second antenna unit 23, and has a first coupling portion 241 and a second coupling portion 242. The coupling conductor 24 has a plurality of bendings, by which the overall size of the coupling conductor line 24 could be further decreased. There is a first coupling gap 2412 between the first coupling portion 241 and the first antenna unit 22, and there is a second coupling gap 2413 between the second coupling portion 242 and the second antenna unit 23. The first coupling gap 2412 and the second coupling gap 2413 are all smaller than a two percent wavelength of a lowest operating frequency of a lowest communication system band commonly covered by the first and the second lower operating bands. A length of a path 243 of the coupling conductor line 24 is between a ⅓ wavelength and a ¾ wavelength of a center operating frequency of the lowest communication system band commonly covered by the first and second lower operating bands.

The grounding conductor line 15 is disposed between the first antenna unit 22 and the second antenna unit 23, and is electrically connected to the ground 11. A length of a path 151 of the grounding conductor line 15 is between a ⅙ wavelength and a ½ wavelength of the center operating frequency of the lowest communication system band commonly covered by the first and the second higher operating bands.

In the multi-band multi-antenna system 2, the first conductor portion 221 and the second conductor portion 231 respectively have the short-circuit portion 227 and the short-circuit portion 237 electrically connected to the ground 11. The short-circuit portions 227 and 237 could be respectively configured to adjust the impedance matching of the resonance modes of the first and the second antenna units 22 and 23. The first and the second low-pass filtering portions 222 and 232 also achieve the same functions as those of the first and the second low-pass filtering portions 122 and 132 of the multi-band multi-antenna system 1 to reduce the degrees of dependent relationship between the lower and the higher operating bands of the first antenna unit 22 and the second antenna unit 23, and could also effectively reduce overall sizes of the first and the second antenna units 22 and 23. Although the coupling conductor line 24 has a plurality of bendings, the first and the second coupling gaps 2412 and 2413 could also guide near field energy of the first and the second antenna units 22 and 23 to the coupling conductor line 24 to achieve the same effect as that of the coupling conductor line 14 of the multi-band multi-antenna system 1. Therefore, the coupling conductor line 24 could also effectively enhance isolation of the lower operating bands of the first antenna unit 22 and the second antenna unit 23. Moreover, the grounding conductor line 15 could also be configured as an isolation mechanism of the higher operating bands of the first antenna unit 22 and the second antenna unit 23, which could effectively enhance the isolation of the higher operating bands of the first antenna unit 22 and the second antenna unit 23. Therefore, the multi-band multi-antenna system 2 could also achieve the same function as that of the multi-band multi-antenna system 1 to achieve a multi-band MIMO, a pattern switchable, a pattern diversity or beam-steering multi-antenna system operation.

Figure 3:
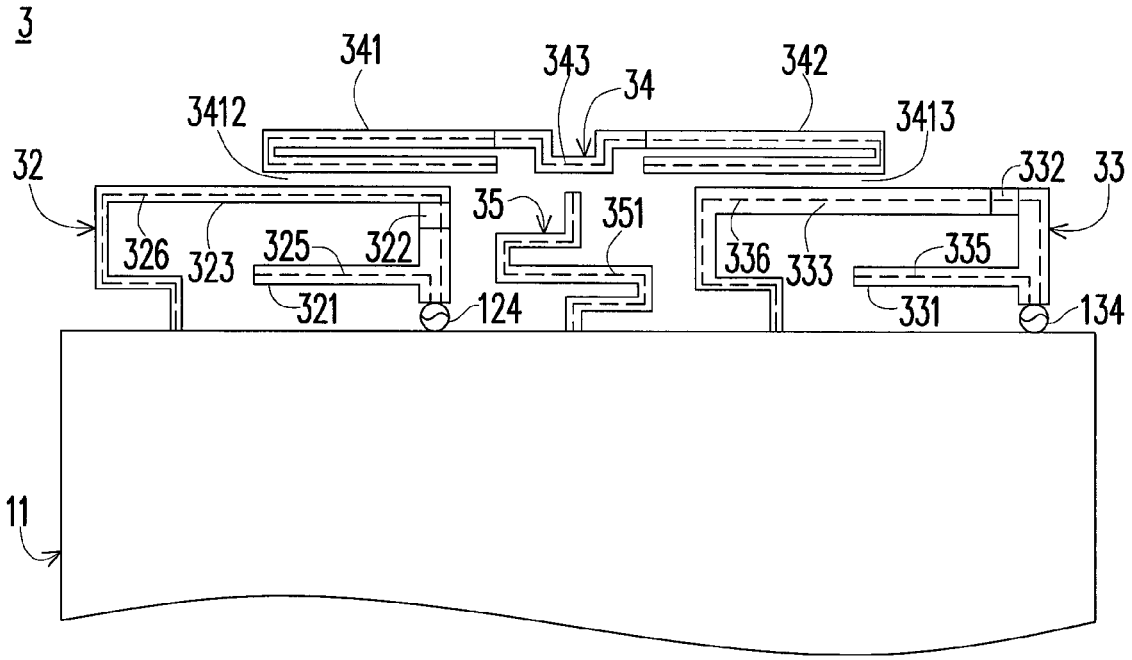
FIG. 3 is a structural schematic diagram of a multi-band multi-antenna system 3 according to an exemplary embodiment of the disclosure.

FIG. 3 is a structural schematic diagram of a multi-band multi-antenna system 3 according to an exemplary embodiment of the disclosure. Referring to FIG. 3, the multi-band multi-antenna system 3 includes the ground 11, a first antenna unit 32, a second antenna unit 33, a coupling conductor line 34 and a grounding conductor line 35. The first antenna unit 32 has the first signal source 124, a first conductor portion 321, a first low-pass filtering portion 322 and a first extending conductor portion 323. The first conductor portion 321 is electrically coupled to the ground 11 through the first signal source 124. The first conductor portion 321 forms a first higher band resonance path 325 of the first antenna unit 32, and the first higher band resonance path 325 generates a first higher operating band. One end of the first extending conductor portion 323 is electrically connected to the ground 11. The first conductor portion 321, the first low-pass filtering portion 322 and the first extending conductor portion 323 form a first lower band resonance path 326 of the first antenna unit 32, and the first lower band resonance path 326 generates a first lower operating band. The first higher operating band and the first lower operating band are respectively configured to transmit or receive electromagnetic signals of at least one communication system band. The first low-pass filtering portion 322 may be, for example, a chip inductor, a low-pass filtering device, a low-pass filtering circuit or a meandered thin conductor line.

The second antenna unit 33 has the second signal source 134, a second conductor portion 331, a second low-pass filtering portion 332 and a second extending conductor portion 333. The second conductor portion 331 is electrically coupled to the ground 11 through the second signal source 134. The second conductor portion 331 forms a second higher band resonance path 335 of the second antenna unit 33, and the second higher band resonance path 335 generates a second higher operating band.

One end of the second extending conductor portion 333 is electrically connected to the ground 11. The second conductor portion 331, the second low-pass filtering portion 332 and the second extending conductor portion 333 form a second lower band resonance path 336 of the second antenna unit 33, and the second lower band resonance path 336 generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band. The second low-pass filtering portion 332 may be, for example, a chip inductor, a low-pass filtering device, a low-pass filtering circuit or a meandered thin conductor line.

The coupling conductor line 34 is disposed nearby the first antenna unit 32 and the second antenna unit 33, and has a first coupling portion 341 and a second coupling portion 342. The coupling conductor 34 has a plurality of bendings. The first coupling portion 341 and the first antenna unit 32 have a first coupling gap 3412, and the second coupling portion 342 and the second antenna unit 33 have a second coupling gap 3413. The first coupling gap 3412 and the second coupling gap 3413 are all smaller than a two percent wavelength of a lowest operating frequency of a lowest communication system band commonly covered by the first and the second lower operating bands. A length of a path 343 of the coupling conductor line 34 is between a ⅓ wavelength and a ¾ wavelength of a center operating frequency of the lowest communication system band commonly covered by the first and second lower operating bands.

The grounding conductor line 35 is disposed between the first antenna unit 32 and the second antenna unit 33, and is electrically connected to the ground 11. The grounding conductor line 35 has a plurality of bendings. A length of a path 351 of the grounding conductor line 35 is between a ⅙ wavelength and a ½ wavelength of the center operating frequency of the lowest communication system band commonly covered by the first and second higher operating bands.

In the multi-band multi-antenna system 3, the first extending conductor portion 323 and the second extending conductor portion 333 are respectively connected to the ground 11 through the first ends thereof. The first lower band resonance path 326 and the second lower band resonance path 336 are also formed, and the first and the second low-pass filtering portions 322 and 332 also have the same effect as that of the first and the second low-pass filtering portions 122 and 132 of the multi-band multi-antenna system 1, which could decrease degrees of the dependent relationship between the lower and the higher operating bands of the first antenna unit 32 and the second antenna unit 33, and could effectively reduce overall sizes of the first and the second antenna units 32 and 33. Although the coupling conductor line 34 and the grounding conductor line 35 respectively have a plurality of bendings, the first and the second coupling gaps 3412 and 3413 could also guide near field energy of the first antenna unit 32 and the second antenna unit 33 to the coupling conductor line 34 to achieve the same function as that of the coupling conductor line 14 of the multi-band multi-antenna system 1. Therefore, the coupling conductor line 34 could effectively enhance isolation of the lower operating bands of the first antenna unit 32 and the second antenna unit 33. Moreover, the grounding conductor line 35 could also be configured as an isolation mechanism of the higher operating bands of the first antenna unit 32 and the second antenna unit 33, which could effectively enhance the isolation of the higher operating bands of the first antenna unit 32 and the second antenna unit 33. Therefore, the multi-band multi-antenna system 3 could also achieve the same function as that of the multi-band multi-antenna system 1.

Figure 4:
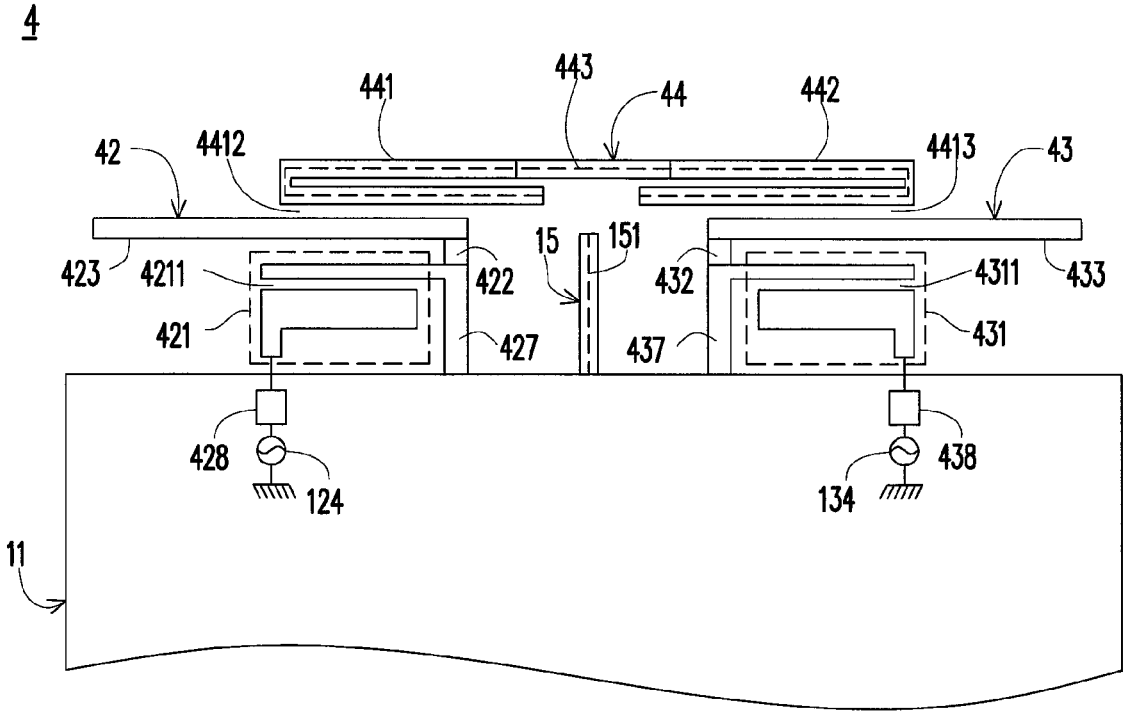
FIG. 4 is a structural schematic diagram of a multi-band multi-antenna system 4 according to an exemplary embodiment of the disclosure.

FIG. 4 is a structural schematic diagram of a multi-band multi-antenna system 4 according to an exemplary embodiment of the disclosure. Referring to FIG. 4, the multi-band multi-antenna system 4 includes the ground 11, a first antenna unit 42, a second antenna unit 43, a coupling conductor line 44 and the grounding conductor line 15. The first antenna unit 42 has the first signal source 124, a first conductor portion 421, a first low-pass filtering portion 422 and a first extending conductor portion 423.

The first conductor portion 421 is electrically coupled to the ground 11 through the first signal source 124. The first conductor portion 421 has a coupling gap 4211. A matching circuit 428 is coupled between the first conductor portion 421 and the first signal source 124. The matching circuit 428 may be replaced by a chip inductor, a capacitor or a switch circuit. The first conductor portion 421 is electrically coupled to the ground 11 through a short-circuit portion 427. The coupling gap 4211, the matching circuit 428 and the short-circuit portion 427 are configured to adjust impedance matching of the resonance mode of the first antenna unit 42. The first conductor portion 421 forms a first higher band resonance path of the first antenna unit 42, and the first higher band resonance path generates a first higher operating band. The first conductor portion 421, the first low-pass filtering portion 422 and the first extending conductor portion 423 form a first lower band resonance path of the first antenna unit 42, and the first lower band resonance path generates a first lower operating band. The first higher operating band and the first lower operating band are respectively configured to transmit or receive electromagnetic signals of at least one communication system band. The first low-pass filtering portion 422 may be, for example, a chip inductor, a low-pass filtering device, a low-pass filtering circuit or a meandered thin conductor line.

The second antenna unit 43 has the second signal source 134, a second conductor portion 431, a second low-pass filtering portion 432 and a second extending conductor portion 433. The second conductor portion 431 is electrically coupled to the ground 11 through the second signal source 134. The second conductor portion 431 has a coupling gap 4311. A matching circuit 438 is coupled between the second conductor portion 431 and the second signal source 124. The matching circuit 438 may be replaced by a chip inductor, a capacitor or a switch circuit. The second conductor portion 431 is electrically coupled to the ground 11 through a short-circuit portion 437. The coupling gap 4311, the matching circuit 438 and the short-circuit portion 437 are configured to adjust impedance matching of the resonance mode of the second antenna unit 43. The second conductor portion 431 forms a second higher band resonance path of the second antenna unit 43, and the second higher band resonance path generates a second higher operating band. The second conductor portion 431, the second low-pass filtering portion 432 and the second extending conductor portion 433 form a second lower band resonance path of the second antenna unit 43, and the second lower band resonance path generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band. The second low-pass filtering portion 432 may be, for example, a chip inductor, a low-pass filtering device, a low-pass filtering circuit or a meandered thin conductor line. The chip coupling gap 4211 and the coupling gap 4311 are all smaller than a two percent wavelength of a lowest operating frequency of a lowest communication system band commonly covered by the first and the second lower operating bands.

The coupling conductor line 44 is disposed nearby the first antenna unit 42 and the second antenna unit 43, and has a first coupling portion 441 and a second coupling portion 442. The coupling conductor 44 has a plurality of bendings. The first coupling portion 441 and the first antenna unit 42 have a first coupling gap 4412, and the second coupling portion 442 and the second antenna unit 43 have a second coupling gap 4413. The first coupling gap 4412 and the second coupling gap 4413 are all smaller than a two percent wavelength of a lowest operating frequency of a lowest communication system band commonly covered by the first and the second lower operating bands. A length of a path 443 of the coupling conductor line 44 is between a ⅓ wavelength and a ¾ wavelength of a center operating frequency of the lowest communication system band commonly covered by the first and second lower operating bands.

The grounding conductor line 15 is disposed between the first antenna unit 42 and the second antenna unit 43, and is electrically connected to the ground 11. A length of a path 151 of the grounding conductor line 15 is between a ⅙ wavelength and a ½ wavelength of the center operating frequency of the lowest communication system band commonly covered by the first and second higher operating bands.

The first conductor portion 421 and the second conductor portion 431 respectively have the coupling gap 4211 and the coupling gap 4311. The first conductor portion 421 and the second conductor portion 431 are respectively coupled to the ground 11 through the short-circuit portion 427 and the short-circuit portion 437. The matching circuit 428 and the matching circuit 438 are respectively coupled between the first conductor portion 421 and the first signal source 124 and between the second conductor portion 431 and the second signal source 134. The coupling gaps 4211 and 4311, the matching circuits 428 and 438 and the short-circuit portions 427 and 437 are all configured to adjust impedance matching of the resonance mode of the first and the second antenna units 42 and 43. The first and the second low-pass filtering portions 422 and 432 could also have the same effect as that of the first and the second low-pass filtering portions 122 and 132 of the multi-band multi-antenna system 1, which could reduce degrees of the dependent relationship between the lower and the higher operating bands of the first antenna unit 42 and the second antenna unit 43, and could also effectively reduce overall sizes of the first and the second antenna units 42 and 43. Although the coupling conductor line 44 has a plurality of bendings, the first and the second coupling gaps 4412, 4413 could also guide near field energy of the first and the second antenna units 42 and 43 to the coupling conductor line 44 to achieve the same effect as that of the coupling conductor line 14 of the multi-band multi-antenna system 1. Therefore, the coupling conductor line 44 could also effectively enhance isolation of the lower operating bands of the first antenna unit 42 and the second antenna unit 43. Moreover, the grounding conductor line 15 could be configured as an isolation mechanism of the higher operating bands of the first antenna unit 42 and the second antenna unit 43, which could effectively enhance the isolation of the higher operating bands of the first antenna unit 42 and the second antenna unit 43. Therefore, the multi-band multi-antenna system 4 could also achieve the same function as that of the multi-band multi-antenna system 1.

Figure 5A:
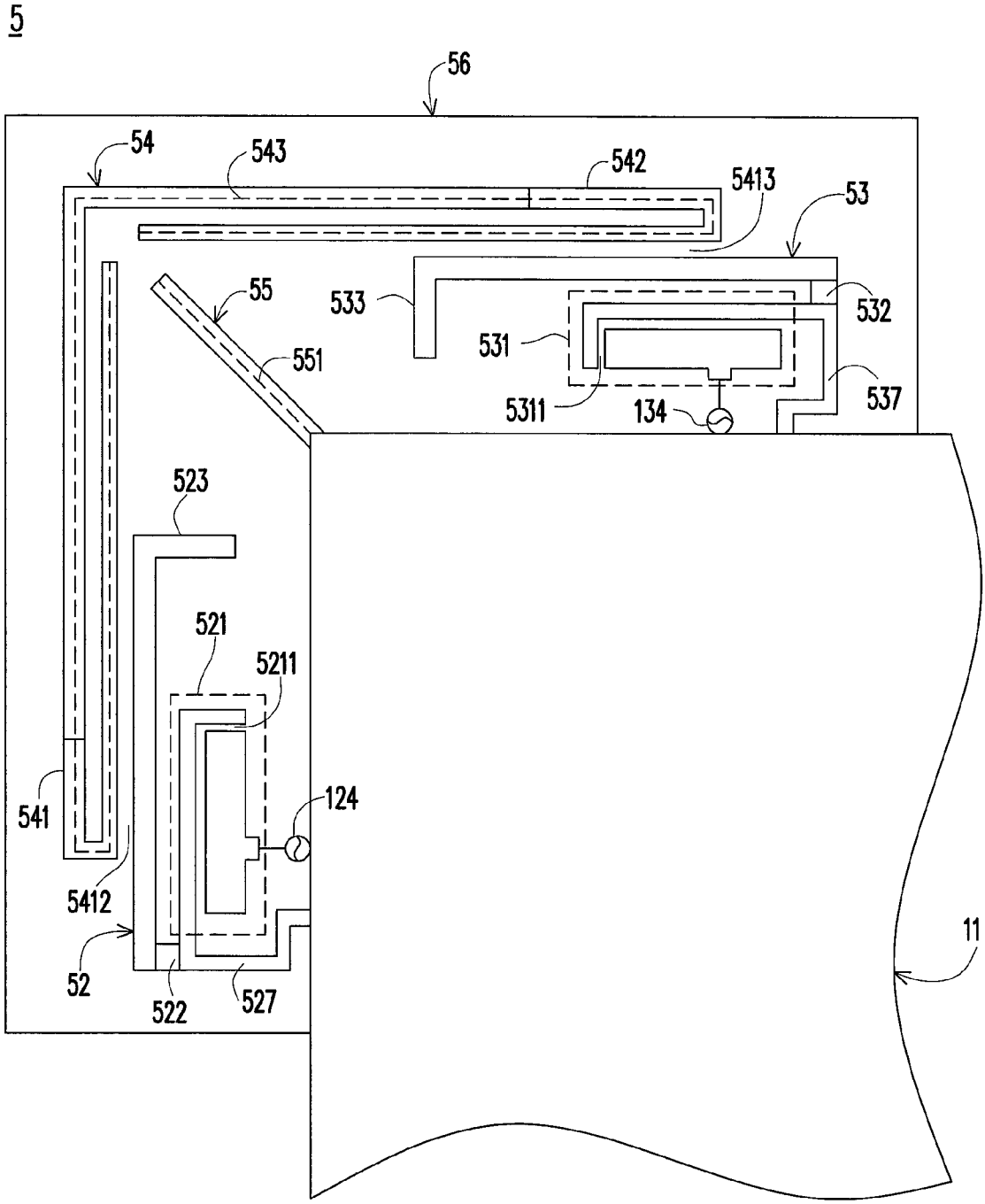
FIG. 5A is a structural schematic diagram of a multi-band multi-antenna system 5 according to an exemplary embodiment of the disclosure.

FIG. 5A is a structural schematic diagram of a multi-band multi-antenna system 5 according to an exemplary embodiment of the disclosure. Referring to FIG. 5, the multi-band multi-antenna system 5 includes the ground 11, a first antenna unit 52, a second antenna unit 53, a coupling conductor line 54 and a grounding conductor line 55. The first and the second antenna units 52 and 53 are respectively disposed at two adjacent edges of a corner of the ground 11. An included angle of the two adjacent edges of the corner of the ground 11 may be a right angle, an acute angle or an obtuse angle. Moreover, the first and the second antenna units 52 and 53, the coupling conductor line 54 and the grounding conductor line 55 are formed on a surface of a dielectric substrate 56 through a printing or etching process. The first and the second antenna units 52 and 53, the coupling conductor line 54 and the grounding conductor line 55 may be formed on different surfaces of the dielectric substrate 56 through the printing or etching process.

The first antenna unit 52 has the first signal source 124, a first conductor portion 521, a first low-pass filtering portion 522 and a first extending conductor portion 523. The first conductor portion 521 is electrically coupled to the ground 11 through the first signal source 124. The first conductor portion 521 has a coupling gap 5211. The first conductor portion 521 is electrically coupled to the ground 11 through a short-circuit portion 527. The coupling gap 5211 and the short-circuit portion 527 may be configured to adjust impedance matching of the resonance mode of the first antenna unit 52. The first conductor portion 521 forms a first higher band resonance path of the first antenna unit 52, and the first higher band resonance path generates a first higher operating band. The first conductor portion 521, the first low-pass filtering portion 522 and the first extending conductor portion 523 form a first lower band resonance path of the first antenna unit 52, and the first lower band resonance path generates a first lower operating band. The first higher operating band and the first lower operating band are respectively configured to transmit or receive electromagnetic signals of at least one communication system band. The first low-pass filtering portion 522 may be, for example, a chip inductor, a low-pass filtering device, a low-pass filtering circuit or a meandered thin conductor line.

The second antenna unit 53 has the second signal source 134, a second conductor portion 531, a second low-pass filtering portion 532 and a second extending conductor portion 533. The second conductor portion 531 is electrically coupled to the ground 11 through the second signal source 134. The second conductor portion 531 has a coupling gap 5311. The second conductor portion 531 is electrically coupled to the ground 11 through a short-circuit portion 537. The coupling gap 5311 and the short-circuit portion 537 may be configured to adjust impedance matching of the resonance mode of the second antenna unit 53. The second conductor portion 531 forms a second higher band resonance path of the second antenna unit 53, and the second higher band resonance path generates a second higher operating band. The second conductor portion 531, the second low-pass filtering portion 532 and the second extending conductor portion 533 form a second lower band resonance path of the second antenna unit 53, and the second lower band resonance path generates a second lower operating band. The second higher operating band and the second lower operating band are respectively configured to transmit or receive electromagnetic signals of at least one communication system band. The first and second lower operating bands cover at least one same communication system band; and the first and second higher operating bands cover at least one same communication system band. The second low-pass filtering portion 532 may be, for example, a chip inductor, a low-pass filtering device, a low-pass filtering circuit or a meandered thin conductor line. The chip coupling gap 5211 and the coupling gap 5311 are all smaller than a two percent wavelength of a lowest operating frequency of a lowest communication system band commonly covered by the first and the second lower operating bands.

The coupling conductor line 54 is disposed nearby the first antenna unit 52 and the second antenna unit 53, and has a first coupling portion 541 and a second coupling portion 542. The coupling conductor 54 has a plurality of bendings. The first coupling portion 541 and the first antenna unit 52 have a first coupling gap 5412, and the second coupling portion 542 and the second antenna unit 53 have a second coupling gap 5413. The first coupling gap 5412 and the second coupling gap 5413 are all smaller than a two percent wavelength of a lowest operating frequency of a lowest communication system band commonly covered by the first and the second lower operating bands. A length of a path 543 of the coupling conductor line 54 is between a ⅓ wavelength and a ¾ wavelength of a center operating frequency of the lowest communication system band commonly covered by the first and second lower operating bands.

The grounding conductor line 55 is disposed between the first antenna unit 52 and the second antenna unit 53, and is electrically connected to the ground 11. A length of a path 551 of the grounding conductor line 55 is between a ⅙ wavelength and a ½ wavelength of the center operating frequency of the lowest communication system band commonly covered by the first and second higher operating bands.

In the multi-band multi-antenna system 5, the first and the second antenna units 52 and 53 are respectively disposed at two adjacent edges of a corner of the ground 11. The first and the second antenna units 52 and 53, the coupling conductor line 54 and the grounding conductor line 55 are formed on a surface of the dielectric substrate 56 through a printing or etching process. The first conductor portion 521 and the second conductor portion 531 respectively have the coupling gap 5211 and the coupling gap 5311. The first conductor portion 521 and the second conductor portion 531 are respectively coupled to the ground 11 through the short-circuit portion 527 and the short-circuit portion 537. The coupling gaps 5211 and 5311 and the short-circuit portions 527 and 537 are all configured to adjust impedance matching of the resonance mode of the first and the second antenna units 52 and 53.

The first and the second low-pass filtering portions 522 and 532 also have the same functions as those of the first and the second low-pass filtering portions 122 and 132 of the multi-band multi-antenna system 1, which could decrease the dependent relationship between the lower and the higher operating bands of the first antenna unit 52 and the second antenna unit 53, and could effectively reduce overall sizes of the first and the second antenna units 52 and 53. Although the coupling conductor line 54 has a plurality of bendings, the first and the second coupling gaps 5412 and 5413 could also guide near field energy of the first and the second antenna units 52 and 53 to the coupling conductor line 54 to achieve the same effect as that of the coupling conductor line 14 of the multi-band multi-antenna system 1. Therefore, the coupling conductor line 54 could also effectively enhance isolation of the lower operating bands of the first antenna unit 52 and the second antenna unit 53. Moreover, the grounding conductor line 55 could be configured as an isolation mechanism of the higher operating bands of the first antenna unit 52 and the second antenna unit 53, which could effectively enhance the isolation of the higher operating bands of the first antenna unit 52 and the second antenna unit 53. Therefore, the multi-band multi-antenna system 5 could also achieve the same function as that of the multi-band multi-antenna system 1 to achieve a multi-band MIMO, a pattern switchable, a pattern diversity or beam-steering multi-antenna system operation.

Figure 5B:
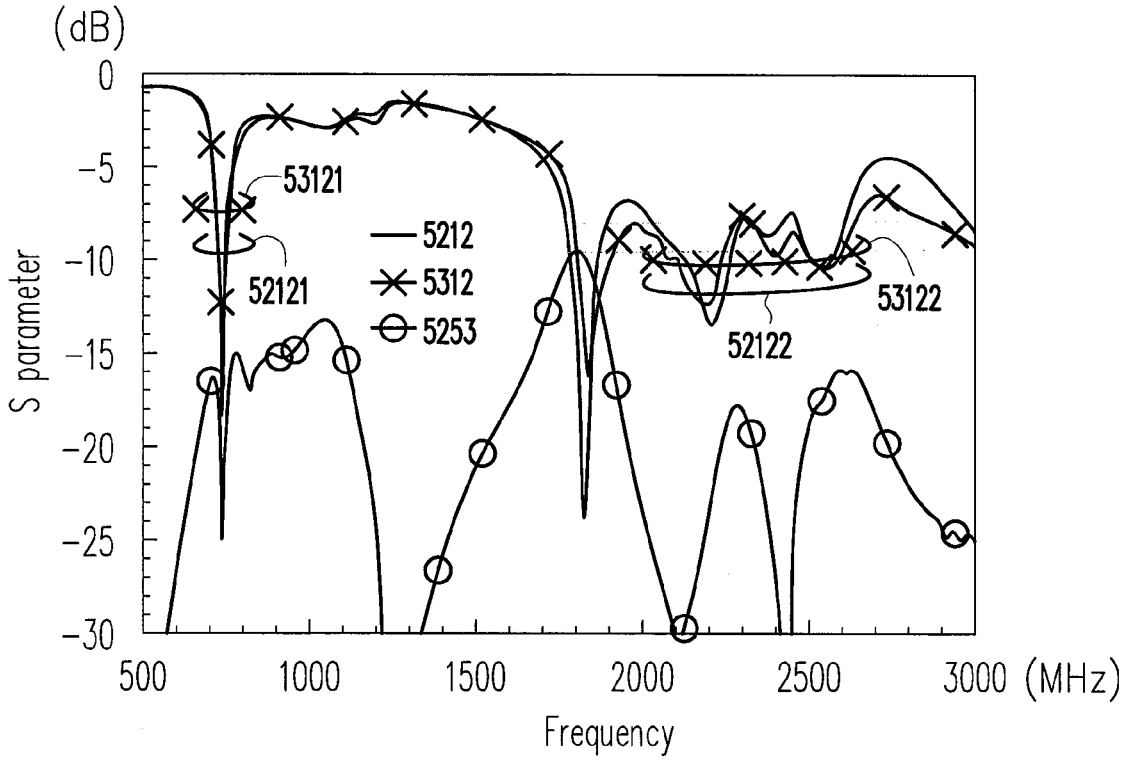
FIG. 5B is a diagram illustrating scattering parameter curves of the multi-band multi-antenna system 5 according to an exemplary embodiment of the disclosure.

FIG. 5B is a comparison diagram of measured antenna scattering parameter curves of the multi-band multi-antenna system 5 of FIG. 5A. Following sizes are chosen for experiment: an area of the ground 11 is about 250×150 $mm^2$; a thickness of the dielectric substrate 56 is about 0.4 mm; a length of each of the first and the second conductor portions 521 and 531 is about 29 mm, and a width thereof is about 15 mm; each of the coupling gaps 5211 and 5311 approximately has an inverted L-shape, and a total space length thereof is about 27 mm, and the coupling gap is about 0.5 mm; the first and the second low-pass filtering portions 522 and 532 are respectively a chip inductor, and an inductance thereof is about 10 nH; each of the first and the second extending conductor portions 523 and 533 approximately has an inverted L-shape, a total length thereof is about 50 mm, and a width thereof is about 1 mm; a length of each of the short-circuit portion 527 and 537 is about 24 mm, and a width thereof is about 1 mm; a length of the coupling conductor line 54 is about 270 mm, and a width thereof is about 0.5 mm; the first coupling gap 5412 and the second coupling gap 5413 are respectively 0.5 mm; a total path length of the grounding conductor line 55 is about 14 mm, and a width thereof is about 0.7 mm. A measured return loss curve of the first antenna unit 52 is 5212, and a measured return loss curve of the second antenna unit 53 is 5312. An isolation curve between the first and the second antenna units 52 and 53 is 5253.

The first conductor portion 521 forms the first higher band resonance path of the first antenna unit 52, and the first higher band resonance path generates a first higher operating band 52122. The first conductor portion 521, the first low-pass filtering portion 522 and the first extending conductor portion 523 form the first lower band resonance path of the first antenna unit 52, and the first lower band resonance path generates a first lower operating band 52121. The second conductor portion 531 forms the second higher band resonance path of the second antenna unit 53, and the second higher band resonance path generates a second higher operating band 53122. The second conductor portion 531, the second low-pass filtering portion 532 and the second extending conductor portion 533 form the second lower band resonance path of the second antenna unit 53, and the second lower band resonance path generates a second lower operating band 53121.

In the present embodiment, the first and the second lower operating bands 52121 and 53121 of the multi-band multi-antenna system 5 commonly cover a communication system band (704-862 MHz) of a long term evolution (LTE) system LTE700, and the first and the second higher operating bands 52122 and 53122 commonly cover communication system bands of an LTE2300 (2300-2400 MHz) and an LTE2500 (2500-2690 MHz). The coupling gap 5211 and the coupling gap 5311 are all smaller than a two percent wavelength of the lowest operating frequency (704 MHz) of the lowest communication system band (LTE700) commonly covered by the first and the second lower operating bands 52121 and 53121. The first chip coupling gap 5412 and the second coupling gap 5413 are all smaller than a two percent wavelength of the lowest operating frequency (704 MHz) of the lowest communication system band (LTE700) commonly covered by the first and the second lower operating bands 52121 and 53121. A length of the path 543 of the coupling conductor line 54 is between a ⅓ wavelength and a ¾ wavelength of a center operating frequency (783 MHz) of the lowest communication system band (LTE700) commonly covered by the first and second lower operating bands 52121 and 53121. A length of the path 551 of the grounding conductor line 55 is between a ⅙ wavelength and a ½ wavelength of the center operating frequency (2350 MHz) of the lowest communication system band (LTE2300) commonly covered by the first and second higher operating bands 52122 and 53122.

The first and the second low-pass filtering portion 522 and 532 can effectively suppress the higher-order modes other than the fundamental modes of the resonance paths of the first and the second lower operating bands 52121 and 53121. Therefore, the first and the second lower operating bands 52121 and 53121 of the first and the second antenna units 52 and 53 are respectively formed by the first resonance mode of the first and the second lower band resonance paths thereof. The first and the second low-pass filtering portion 522 and 532 can also effectively suppress the resonance currents of the first and the second higher operating bands 52122 and 53122 from passing through the low-pass filtering portions. The first and the second higher operating bands 52122 and 53122 are respectively formed by the first resonant mode of the first and the second higher band resonance paths. In this way, the first and the second low-pass filtering portions 522 and 532 can effectively reduce the dependent relationship between the lower and the higher operating bands of the first and the second antenna units 52 and 53. Therefore, the coupling conductor line 54 may be effectively configured as an isolation mechanism of the first and the second lower operating bands 52121 and 53121, which could effectively reduce an energy coupling degree of the communication system band (LTE700) commonly covered by the first and the second lower operating bands 52121 and 53121. The grounding conductor line 55 may be effectively configured as an isolation mechanism of the first and the second higher operating bands 52122 and 53122, which could effectively reduce an energy coupling degree of the communication system band (LTE2300/2500) commonly covered by the first and the second higher operating bands 52122 and 53122. Therefore, according to the isolation curve 5253 of the first and the second antenna units 52 and 53 of FIG. 5B, it is known that good isolation (higher than 15 dB) is achieved within the first and the second lower operating bands 52121 and 53121, and good isolation (higher than 15 dB) is also achieved within the first and the second higher operating bands 52122 and 53122.

However, FIG. 5B is only an example of the multi-band multi-antenna system 5 of FIG. 5A, in which the first higher and lower operating bands 52122 and 52121 are respectively configured to transmit or receive electromagnetic signals of at least one communication system band; the second higher operating band 53122 and the second lower operating bands 53121 are respectively configured to transmit or receive electromagnetic signals of at least one communication system band; the first and the second lower operating bands 52121 and 53121 cover at least one same communication system band; and the first and the second higher operating bands 52122 and 53122 cover at least one same communication system band. The lower and higher operating bands of the first and the second antenna units 52 and 53 may be designed to transmit or receive electromagnetic signals of a global system for mobile communications (GSM), a universal mobile telecommunications system (UMTS), a worldwide interoperability for microwave access (WiMAX) system, a digital television broadcasting (DTV) system, a global positioning system (GPS), a wireless wide area network (WWAN) system, a wireless local area network (WLAN) system, an ultra-wideband (UWB) system, a wireless personal area network (WPAN), a global positioning system (GPS), a satellite communication system or other wireless or mobile communication band applications.

Figure 5C:
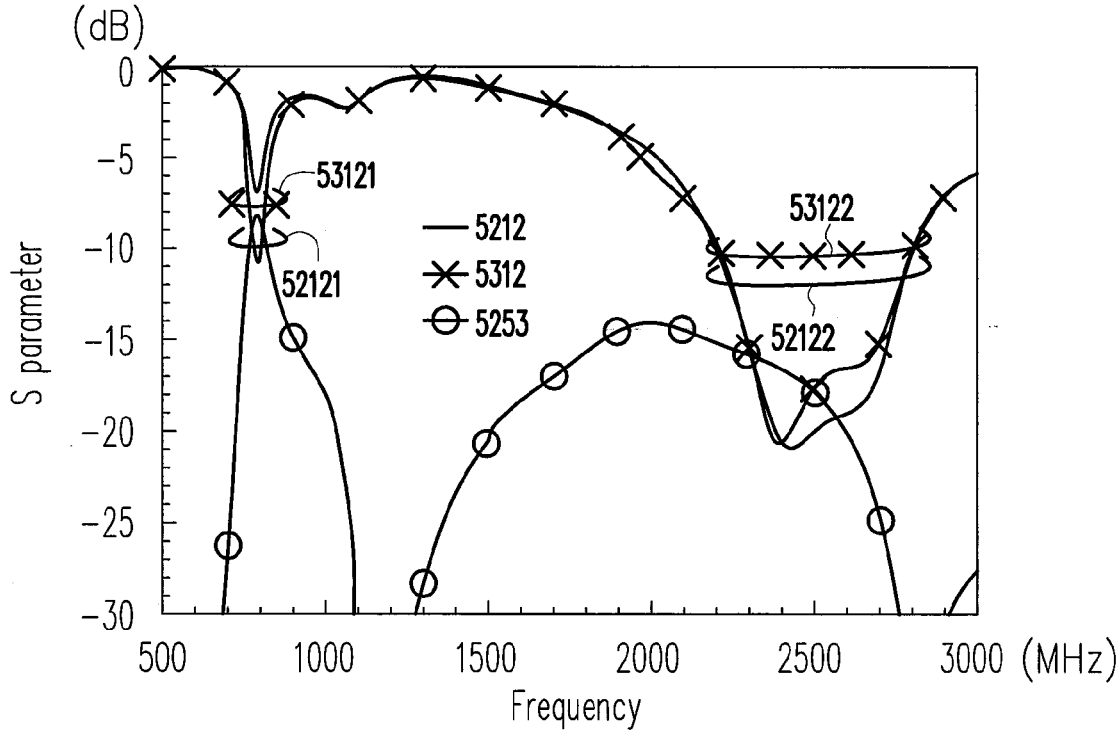
FIG. 5C is a diagram illustrating scattering parameter curves of the multi-band multi-antenna system 5 in case that a coupling conductor line 54 is not applied.

FIG. 5C is a comparison diagram of measured antenna scattering parameter (S-parameter) curves of the multi-band multi-antenna system 5 of FIG. 5A in case that the coupling conductor line 54 is not applied. According to the isolation curve 5253 of the first and the second antenna units 52 and 53 of FIG. 5C, it is known that when the multi-band multi-antenna system 5 does not use the coupling conductor line 54, the isolation within the first and the second lower operating bands 52121 and 53121 obviously gets worse in comparison with FIG. 5B, though good isolation (higher than 15 dB) is still achieved within the first and the second higher operating bands 52122 and 53122.

Figure 5D:
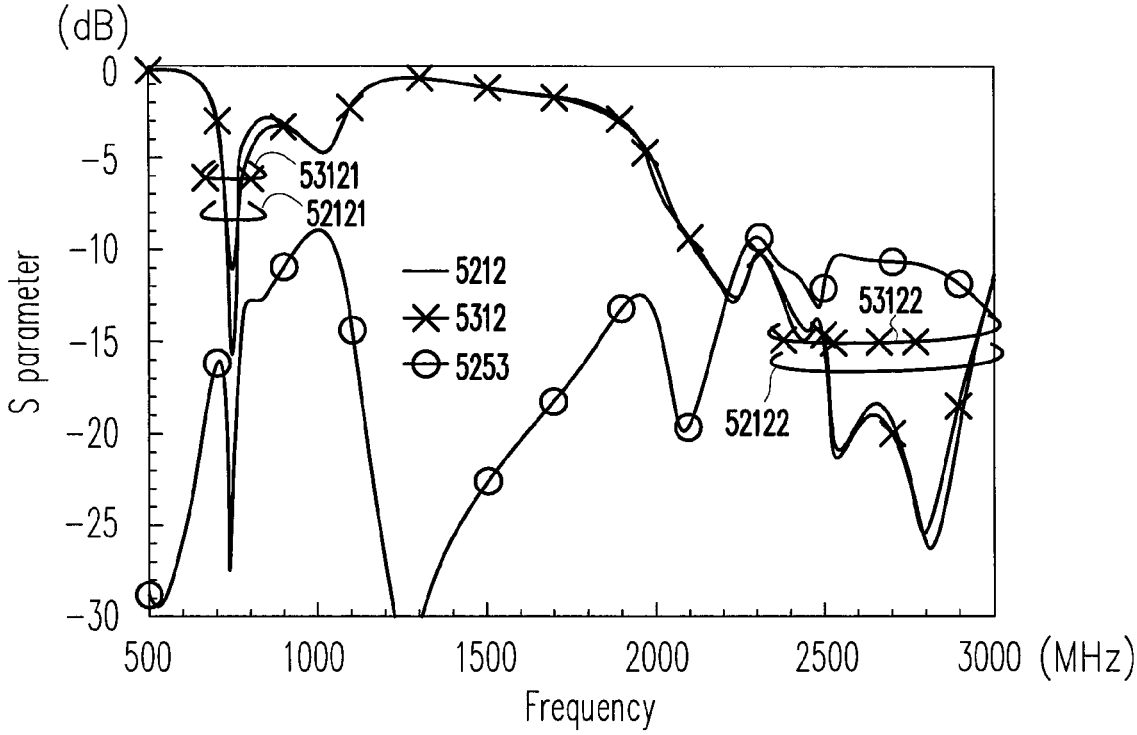
FIG. 5D is a diagram illustrating scattering parameter curves of the multi-band multi-antenna system 5 in case that a grounding conductor line 55 is not applied.

FIG. 5D is a comparison diagram of measured antenna scattering parameter curves of the multi-band multi-antenna system 5 of FIG. 5A in case that the grounding conductor line 55 is not applied. Referring to FIG. 5D and compared to FIG. 5B, when the multi-band multi-antenna system 5 does not use the grounding conductor line 55, the isolation within the first and the second higher operating bands 52122 and 53122 obviously get worse, though good isolation (higher than 15 dB) is still achieved within the first and the second lower operating bands 52121 and 53121.

Figure 5E:
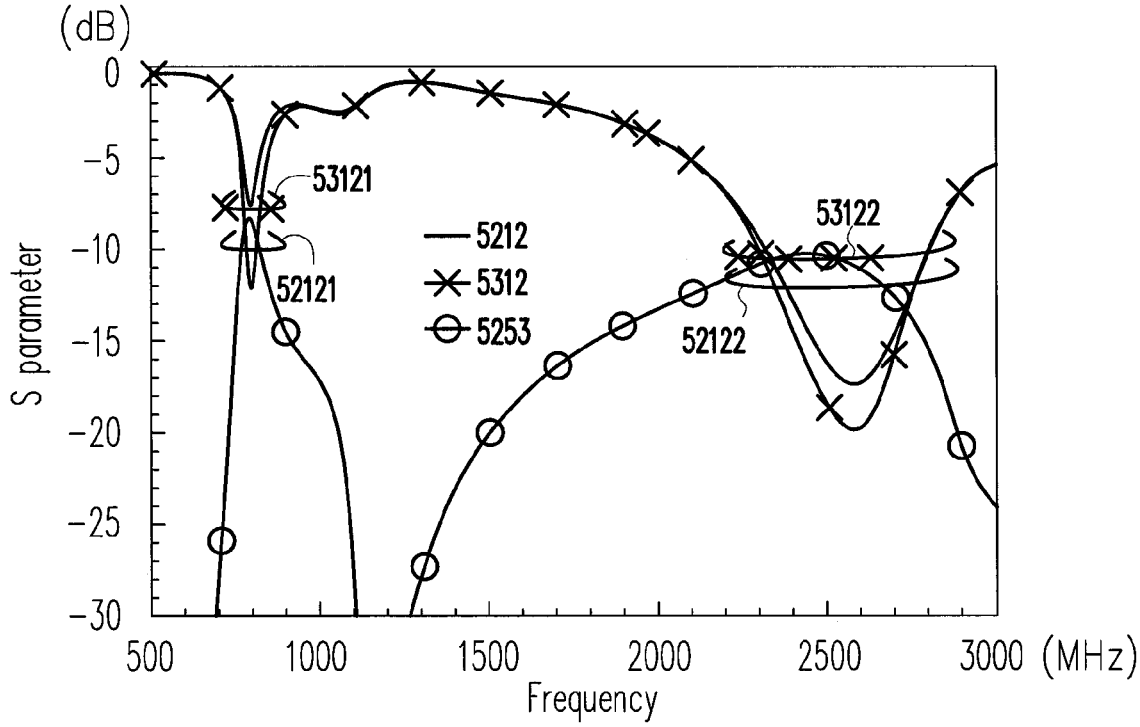
FIG. 5E is a diagram illustrating scattering parameter curves of the multi-band multi-antenna system 5 in case that the coupling conductor line 54 and the grounding conductor line 55 are not applied.

FIG. 5E is a comparison diagram of measured antenna scattering parameter curves of the multi-band multi-antenna system 5 of FIG. 5A in case that the coupling conductor line 54 and the grounding conductor line 55 are not applied. Referring to FIG. 5E and compared to FIG. 5B, when the multi-band multi-antenna system 5 does not use the coupling conductor line 54 and the grounding conductor line 55, the isolation within the first and the second higher operating bands 52122 and 53122 and within the first and the second lower operating bands 52121 and 53121 obviously get worse.

Figure 6A:
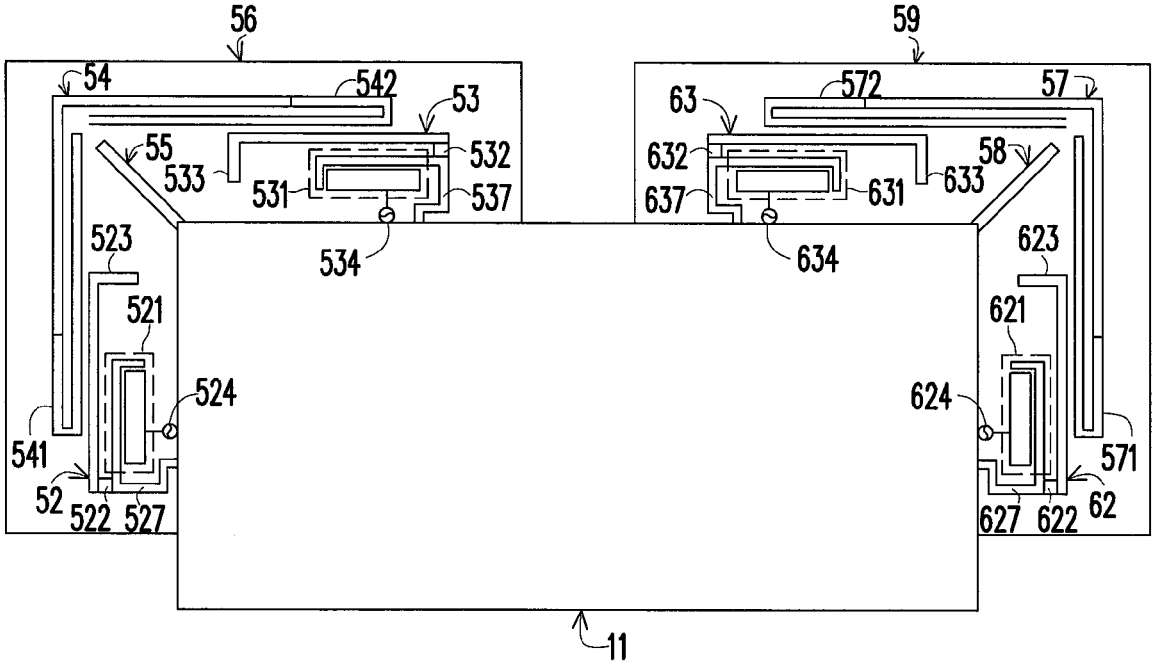
FIG. 6A is a structural schematic diagram of a communication device with a plurality of multi-band multi-antenna systems implemented therein according to an exemplary embodiment of the disclosure.
Figure 6B:
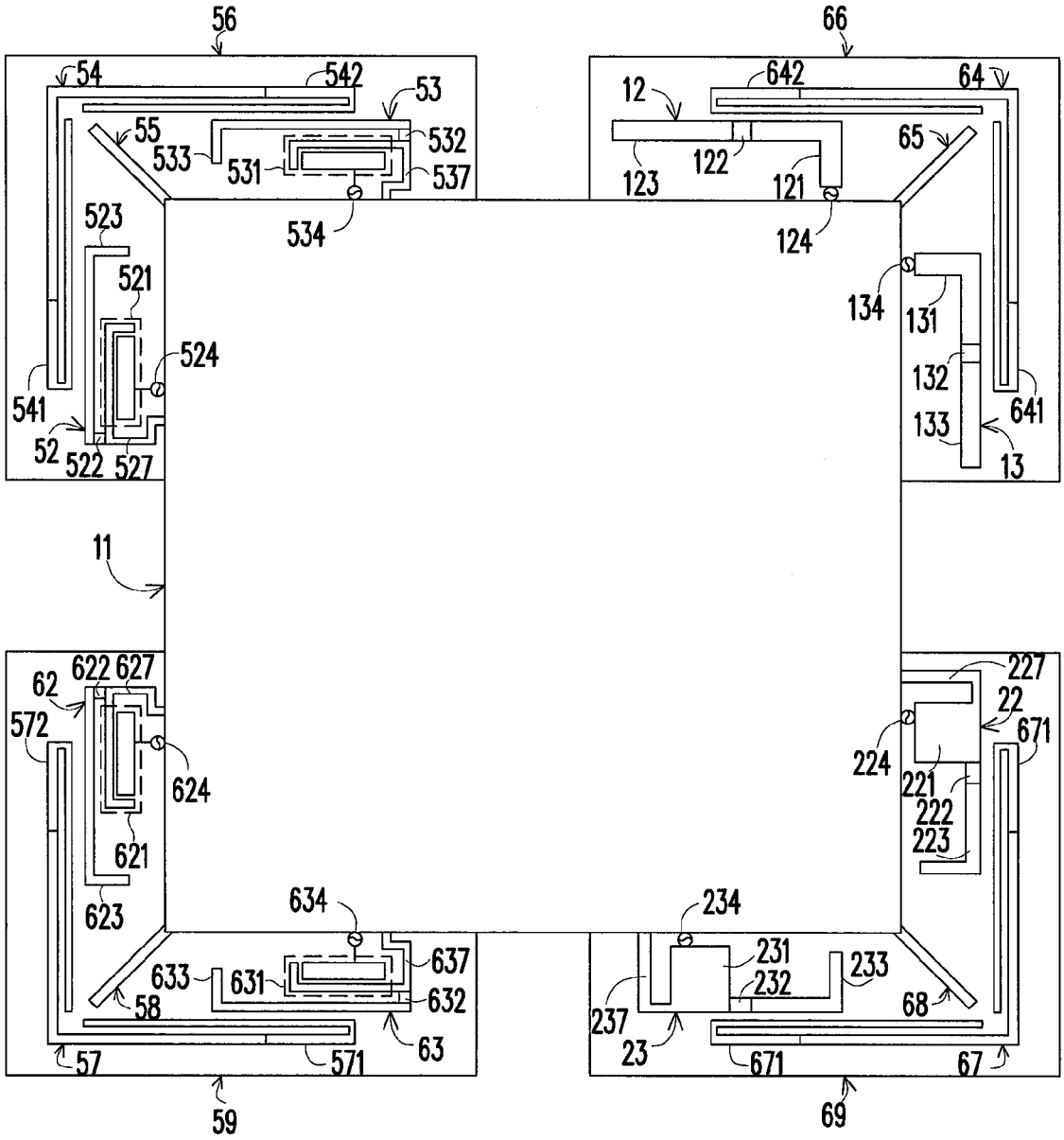
FIG. 6B is a structural schematic diagram of a communication device with a plurality of multi-band multi-antenna systems implemented therein according to an exemplary embodiment of the disclosure.

The exemplary embodiments of the multi-band multi-antenna system of the disclosure may be applied to various communication devices, such as a mobile communication device, a wireless communication device, a mobile computing device, a computer system, or the embodiments may be applied to telecommunication equipment, network equipment or peripheral equipment of computer or network. In practical applications, a plurality of sets of the multi-band multi-antenna system of the disclosure may be configured or implemented in the communication device. FIG. 6A and FIG. 6B are schematic diagrams respectively illustrating a communication device with a plurality of multi-band multi-antenna systems of the disclosure implemented on the ground 11.

Referring to FIG. 6A, in the present embodiment, in addition to that the ground 11 of the communication device is electrically coupled to the multi-band multi-antenna system 5 of FIG. 5A, a second set of multi-band multi-antenna system is further disposed at a corner adjacent to the corner of the ground 11 where the multi-band multi-antenna system 5 is configured, so as to achieve a multi-band MIMO, a pattern switchable, a pattern diversity or a beam-steering multi-antenna system operation. In the multi-band multi-antenna system 5 of FIG. 6A, the first antenna unit 52 is electrically coupled to the ground 11 through a first signal source 524, and the second antenna unit 53 is electrically coupled to the ground 11 through a second signal source 534.

Referring to FIG. 6A, the second set of the multi-band multi-antenna system includes the ground 11, a first antenna unit 62, a second antenna unit 63, a coupling conductor line 57 and a grounding conductor line 58. The first and the second antenna units 62 and 63 are respectively disposed at two adjacent edges of a corner of the ground 11, and the first antenna unit 62, the second antenna unit 63, the coupling conductor line 57 and the grounding conductor line 58 are formed on a surface of a dielectric substrate 59 through a printing or etching process. The first antenna unit 62, the second antenna unit 63, the coupling conductor line 57 and the grounding conductor line 58 may be formed on different surfaces of the dielectric substrate 59 through the printing or etching process.

The first antenna unit 62 has a first signal source 624, a first conductor portion 621, a first low-pass filtering portion 622 and a first extending conductor portion 623. The first conductor portion 621 is electrically coupled to the ground 11 through the first signal source 624. The first conductor portion 621 has a coupling gap. The first conductor portion 621 is electrically coupled to the ground 11 through a short-circuit portion 627. The coupling gap and the short-circuit portion 627 may be configured to adjust impedance matching of the resonance mode of the first antenna unit 62. The first conductor portion 621 forms a first higher band resonance path of the first antenna unit 62, and the first higher band resonance path generates a first higher operating band. The first conductor portion 621, the first low-pass filtering portion 622 and the first extending conductor portion 623 form a first lower band resonance path of the first antenna unit 62, and the first lower band resonance path generates a first lower operating band. The first higher operating band and the first lower operating band are respectively configured to transmit or receive electromagnetic signals of at least one communication system band.

The second antenna unit 63 has a second signal source 634, a second conductor portion 631, a second low-pass filtering portion 632 and a second extending conductor portion 633. The second conductor portion 631 is electrically coupled to the ground 11 through the second signal source 634. The second conductor portion 631 has a coupling gap. The second conductor portion 631 is electrically coupled to the ground 11 through a short-circuit portion 637. The coupling gap and the short-circuit portion 637 may be configured to adjust impedance matching of the resonance mode of the second antenna unit 63. The second conductor portion 631 forms a second higher band resonance path of the second antenna unit 63, and the second higher band resonance path generates a second higher operating band. The second conductor portion 631, the second low-pass filtering portion 632 and the second extending conductor portion 633 form a second lower band resonance path of the second antenna unit 63, and the second lower band resonance path generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band.

The coupling conductor line 57 is disposed nearby the first antenna unit 62 and the second antenna unit 63, and has a first coupling portion 571 and a second coupling portion 572. The coupling conductor 57 has a plurality of bendings. The first coupling portion 571 and the first antenna unit 62 have a first coupling gap, and the second coupling portion 572 and the second antenna unit 63 have a second coupling gap.

The grounding conductor line 58 is disposed between the first antenna unit 62 and the second antenna unit 63, and is electrically connected to the ground 11.

Referring to FIG. 6B, in the present embodiment, in addition to that the ground 11 of the communication device is electrically coupled to the multi-band multi-antenna system 5 of FIG. 5A and the second set of the multi-band multi-antenna system of FIG. 6A, a third set and a fourth set of the multi-band multi-antenna systems are further configured at the other two adjacent corners of the ground 11 of FIG. 6B, so as to achieve a multi-band MIMO or a pattern switchable or a beam-steering multi-antenna system operation.

Referring to FIG. 6B, the third set of the multi-band multi-antenna system includes the ground 11, the first antenna unit 12, the second antenna unit 13, a coupling conductor line 64 and a grounding conductor line 65. The first and the second antenna units 12 and 13 are respectively disposed at two adjacent edges of a corner of the ground 11, and the first antenna unit 12, the second antenna unit 13, the coupling conductor line 64 and the grounding conductor line 65 are formed on a surface of a dielectric substrate 66 through a printing or etching process. The first antenna unit 12, the second antenna unit 13, the coupling conductor line 64 and the grounding conductor line 65 may be formed on different surfaces of the dielectric substrate 66 through the printing or etching process.

The first antenna unit 12 has the first signal source 124, the first conductor portion 121, the first low-pass filtering portion 122 and the first extending conductor portion 123. The first conductor portion 121 is electrically coupled to the ground 11 through the first signal source 124. The first conductor portion 121 forms a first higher band resonance path of the first antenna unit 12, and the first higher band resonance path generates a first higher operating band. The first conductor portion 121, the first low-pass filtering portion 122 and the first extending conductor portion 123 form a first lower band resonance path of the first antenna unit 12, and the first lower band resonance path generates a first lower operating band. The first higher operating band and the first lower operating band are respectively configured to transmit or receive electromagnetic signals of at least one communication system band.

The second antenna unit 13 has the second signal source 134, the second conductor portion 131, the second low-pass filtering portion 132 and the second extending conductor portion 133. The second conductor portion 131 is electrically coupled to the ground 11 through the second signal source 134. The second conductor portion 131 forms a second higher band resonance path of the second antenna unit 13, and the second higher band resonance path generates a second higher operating band. The second conductor portion 131, the second low-pass filtering portion 132 and the second extending conductor portion 133 form a second lower band resonance path of the second antenna unit 13, and the second lower band resonance path generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band.

The coupling conductor line 64 is disposed nearby the first antenna unit 12 and the second antenna unit 13, and has a first coupling portion 641 and a second coupling portion 642. The coupling conductor 64 has a plurality of bendings. The first coupling portion 641 and the first antenna unit 12 have a first coupling gap, and the second coupling portion 642 and the second antenna unit 13 have a second coupling gap. The grounding conductor line 65 is disposed between the first antenna unit 12 and the second antenna unit 13, and is electrically connected to the ground 11.

Referring to FIG. 6B, the fourth set of the multi-band multi-antenna system includes the ground 11, the first antenna unit 22, the second antenna unit 23, a coupling conductor line 67 and a grounding conductor line 68. The first and the second antenna units 22 and 23 are respectively disposed at two adjacent edges of a corner of the ground 11, and the first antenna unit 22, the second antenna unit 23, the coupling conductor line 67 and the grounding conductor line 68 are formed on a surface of a dielectric substrate 69 through a printing or etching process. The first antenna unit 22, the second antenna unit 23, the coupling conductor line 67 and the grounding conductor line 68 may be formed on different surfaces of the dielectric substrate 69 through the printing or etching process.

The first antenna unit 22 has a first signal source 224, the first conductor portion 221, the first low-pass filtering portion 222 and the first extending conductor portion 223. The first conductor portion 221 is electrically coupled to the ground 11 through the first signal source 224. The first conductor portion 221 forms a first higher band resonance path of the first antenna unit 22, and the first higher band resonance path generates a first higher operating band. The first conductor portion 221, the first low-pass filtering portion 222 and the first extending conductor portion 223 form a first lower band resonance path of the first antenna unit 22, and the first lower band resonance path generates a first lower operating band. The first higher operating band and the first lower operating band are respectively configured to transmit or receive electromagnetic signals of at least one communication system band.

The second antenna unit 23 has a second signal source 234, the second conductor portion 231, the second low-pass filtering portion 232 and the second extending conductor portion 233. The second conductor portion 231 is electrically coupled to the ground 11 through the second signal source 234. The second conductor portion 231 forms a second higher band resonance path of the second antenna unit 23, and the second higher band resonance path generates a second higher operating band. The second conductor portion 231, the second low-pass filtering portion 232 and the second extending conductor portion 233 form a second lower band resonance path of the second antenna unit 23, and the second lower band resonance path generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band.

The coupling conductor line 67 is disposed nearby the first antenna unit 22 and the second antenna unit 23, and has a first coupling portion 671 and a second coupling portion 672. The coupling conductor 67 has a plurality of bendings. The first coupling portion 671 and the first antenna unit 22 have a first coupling gap, and the second coupling portion 672 and the second antenna unit 23 have a second coupling gap. The grounding conductor line 68 is disposed between the first antenna unit 22 and the second antenna unit 23, and is electrically connected to the ground 11.

Figure 7:
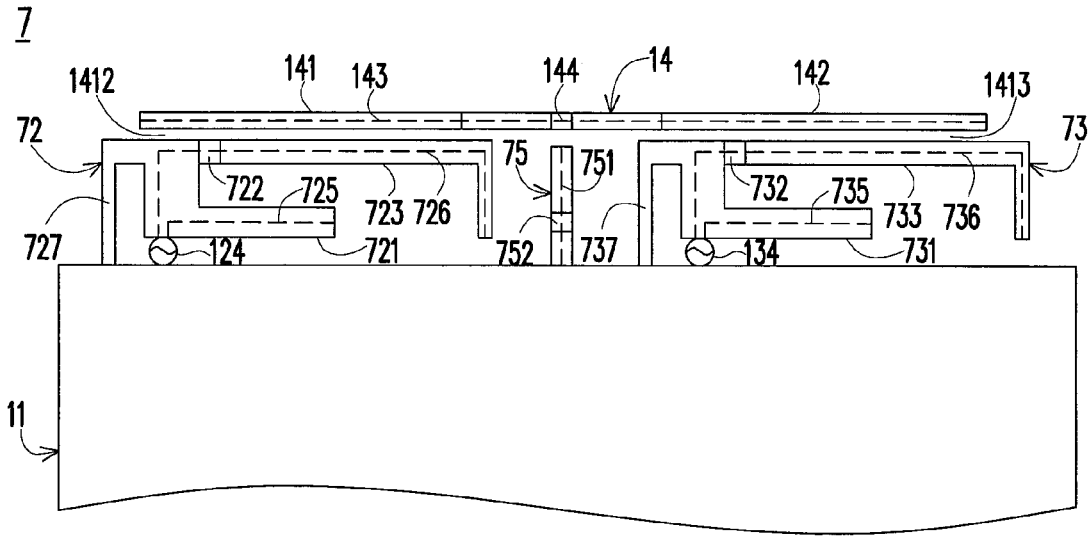
FIG. 7 is a structural schematic diagram of a multi-band multi-antenna system 7 according to an exemplary embodiment of the disclosure.

FIG. 7 is a structural schematic diagram of a multi-band multi-antenna system 7 according to an exemplary embodiment of the disclosure. Referring to FIG. 7, the multi-band multi-antenna system 7 includes the ground 11, a first antenna unit 72, a second antenna unit 73, the coupling conductor line 14 and a grounding conductor line 75. The first antenna unit 72 has the first signal source 124, a first conductor portion 721, a first low-pass filtering portion 722 and a first extending conductor portion 723.

The first conductor portion 721 is electrically coupled to the ground 11 through the first signal source 124. The first conductor portion 721 has a short-circuit portion 727 electrically coupled to the ground 11. The short-circuit portion 727 is configured to adjust impedance matching of the resonance mode of the first antenna unit 72. The first conductor portion 721 forms a first higher band resonance path 725 of the first antenna unit 72, and the first higher band resonance path 725 generates a first higher operating band. The first conductor portion 721, the first low-pass filtering portion 722 and the first extending conductor portion 723 form a first lower band resonance path 726 of the first antenna unit 72, and the first lower band resonance path 726 generates a first lower operating band. The first higher operating band and the first lower operating band are respectively configured to transmit or receive electromagnetic signals of at least one communication system band. The first low-pass filtering portion 722 may be, for example, a chip inductor, a low-pass filtering device, a low-pass filtering circuit or a meandered thin conductor line.

The second antenna unit 73 has the second signal source 134, a second conductor portion 731, a second low-pass filtering portion 732 and a second extending conductor portion 733. The second conductor portion 731 is electrically coupled to the ground 11 through the second signal source 134. The second conductor portion 731 has a short-circuit portion 737 electrically coupled to the ground 11. The short-circuit portion 737 is used to adjust impedance matching of the resonance mode of the second antenna unit 73. The second conductor portion 731 forms a second higher band resonance path 735 of the second antenna unit 73, and the second higher band resonance path 735 generates a second higher operating band. The second conductor portion 731, the second low-pass filtering portion 732 and the second extending conductor portion 733 form a second lower band resonance path 736 of the second antenna unit 73, and the second lower band resonance path 736 generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band. The second low-pass filtering portion 732 is, for example, a chip inductor, a low-pass filtering device, a low-pass filtering circuit or a meandered thin conductor line.

The coupling conductor line 14 is disposed nearby the first antenna unit 72 and the second antenna unit 73, and has the first coupling portion 141 and the second coupling portion 142. The first coupling portion 141 and the first antenna unit 72 have the first coupling gap 1412, and the second coupling portion 142 and the second antenna unit 73 have the second coupling gap 1413. The first coupling gap 1412 and the second coupling gap 1413 are all smaller than a two percent wavelength of a lowest operating frequency of a lowest communication system band commonly covered by the first and the second lower operating bands. A length of the path 143 of the coupling conductor line 14 is between a ⅓ wavelength and a ¾ wavelength of a center operating frequency of the lowest communication system band commonly covered by the first and second lower operating bands. The coupling conductor line 14 has a lumped inductor 144, which is used for further reducing a size of the coupling conductor line 14. The lumped inductor 144 may be a chip capacitor, a filtering device, an electric circuit or a thin conductor line having a plurality of bendings.

The grounding conductor line 75 is disposed between the first antenna unit 72 and the second antenna unit 73, and is electrically connected to the ground 11. A length of a path 751 of the grounding conductor line 75 is between a ⅙ wavelength and a ½ wavelength of the center operating frequency of the lowest communication system band commonly covered by the first and second higher operating bands. The grounding conductor line 75 has a lumped inductor 752, which is used for further reducing a size of the grounding conductor line 75. The lumped inductor 752 may be a chip capacitor, a filtering device, an electronic circuit or a thin conductor line having a plurality of bendings.

The first conductor portion 721 and the second conductor portion 731 respectively have the short-circuit portion 727 and the short-circuit portion 737 electrically connected to the ground 11. The short-circuit portions 727 and 737 may be respectively configured to adjust the impedance matching of the resonance mode of the first and the second antenna units 72 and 73. The coupling conductor line 14 and the grounding conductor line 75 respectively have the lumped inductors 144 and 752, which are configured to further reduce the sizes of the coupling conductor line 14 and the grounding conductor line 75. However, the first and the second low-pass filtering portions 722 and 732 could also achieve a same effect as that of the first and the second low-pass filtering portions 122 and 132 of the multi-band multi-antenna system 1 to reduce the dependent relationship between the lower and the higher operating bands of the first antenna unit 72 and the second antenna unit 73, and effectively reduce overall sizes of the first and the second antenna units 72 and 73. Although the coupling conductor line 14 and the grounding conductor line 75 respectively have the lumped inductors 144 and 752, the first and the second coupling gaps 1412 and 1413 could also guide near field energy of the first and the second antenna units 72 and 73 to the coupling conductor line 14 to achieve the same effect as that of the coupling conductor line 14 of the multi-band multi-antenna system 1. Therefore, the coupling conductor line 14 could effectively enhance isolation of the lower operating bands of the first antenna unit 72 and the second antenna unit 73. Moreover, the grounding conductor line 75 may be configured as an isolation mechanism of the higher operating bands of the first antenna unit 72 and the second antenna unit 73, which may effectively increase the isolation of the higher operating bands of the first antenna unit 72 and the second antenna unit 73. Therefore, the multi-band multi-antenna system 7 could also achieve the same function as that of the multi-band multi-antenna system 1.

Figure 8:
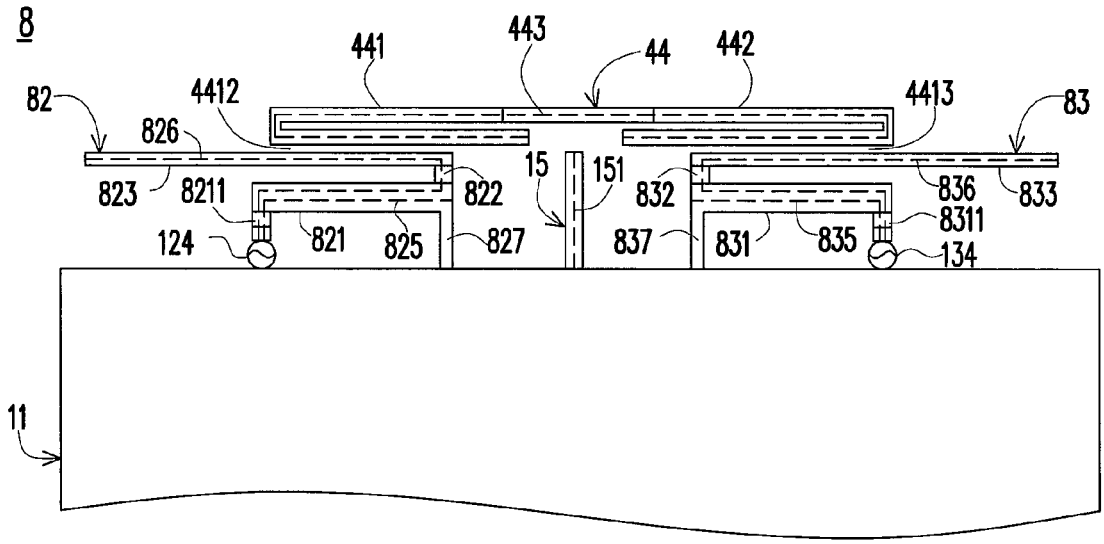
FIG. 8 is a structural schematic diagram of a multi-band multi-antenna system 8 according to an exemplary embodiment of the disclosure.

FIG. 8 is a structural schematic diagram of a multi-band multi-antenna system 8 according to an exemplary embodiment of the disclosure. Referring to FIG. 8, the multi-band multi-antenna system 8 includes the ground 11, a first antenna unit 82, a second antenna unit 83, a coupling conductor line 84 and the grounding conductor line 15. The first antenna unit 82 has the first signal source 124, a first conductor portion 821, a first low-pass filtering portion 822 and a first extending conductor portion 823. The first conductor portion 821 is electrically coupled to the ground 11 through the first signal source 124. The first conductor portion 821 has a chip capacitor 8211. The first conductor portion 821 also has a short-circuit portion 827 electrically coupled to the ground 11. The chip capacitor 8211 and the short-circuit portion 827 may be used to adjust impedance matching of the resonance mode of the first antenna unit 82. The chip capacitor 8211 may be replaced by a matching circuit. The first conductor portion 821 forms a first higher band resonance path 825 of the first antenna unit 82, and the first higher band resonance path 825 generates a first higher operating band. The first conductor portion 821, the first low-pass filtering portion 822 and the first extending conductor portion 823 form a first lower band resonance path 826 of the first antenna unit 82, and the first lower band resonance path 826 generates a first lower operating band. The first higher operating band and the first lower operating band are respectively configured to transmit or receive electromagnetic signals of at least one communication system band. The first low-pass filtering portion 822 may be, for example, a chip inductor, a low-pass filtering device, a low-pass filtering circuit or a meandered thin conductor line.

The second antenna unit 83 has the second signal source 134, a second conductor portion 831, a second low-pass filtering portion 832 and a second extending conductor portion 833. The second conductor portion 831 is electrically coupled to the ground 11 through the second signal source 134. The second conductor portion 831 has a chip capacitor 8311. The chip capacitor 8311 may be replaced by a matching circuit. The second conductor portion 831 also has a short-circuit portion 837 electrically coupled to the ground 11. The chip capacitor 8311 and the short-circuit portion 837 may be configured to adjust impedance matching of the resonance mode of the second antenna unit 83. The second conductor portion 831 forms a second higher band resonance path 835 of the second antenna unit 83, and the second higher band resonance path 835 generates a second higher operating band. The second conductor portion 831, the second low-pass filtering portion 832 and the second extending conductor portion 833 form a second lower band resonance path 836 of the second antenna unit 83, and the second lower band resonance path 836 generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band. The second low-pass filtering portion 832 may be, for example, a chip inductor, a low-pass filtering device, a low-pass filtering circuit or a meandered thin conductor line.

The coupling conductor line 44 is disposed nearby the first antenna unit 82 and the second antenna unit 83, and has a first coupling portion 441 and a second coupling portion 442. The coupling conductor line 44 has a plurality of bendings, which are configured to further reduce a size of the coupling conductor line 44. The first coupling portion 441 and the first antenna unit 82 have a first coupling gap 4412, and the second coupling portion 442 and the second antenna unit 83 have a second coupling gap 4413. The first coupling gap 4412 and the second coupling gap 4413 are all smaller than a two percent wavelength of a lowest operating frequency of a lowest communication system band commonly covered by the first and the second lower operating bands. A length of a path 443 of the coupling conductor line 44 is between a ⅓ wavelength and a ¾ wavelength of a center operating frequency of the lowest communication system band commonly covered by the first and second lower operating bands.

The grounding conductor line 15 is disposed between the first antenna unit 82 and the second antenna unit 83, and is electrically connected to the ground 11. A length of the path 151 of the grounding conductor line 15 is between a ⅙ wavelength and a ½ wavelength of the center operating frequency of the lowest communication system band commonly covered by the first and second higher operating bands.

The first conductor portion 821 and the second conductor portion 831 respectively have the chip capacitor 8211 and the chip capacitor 8311. Moreover, the first conductor portion 821 and the second conductor portion 831 respectively have the short-circuit portion 827 and the short-circuit portion 837 electrically connected to the ground 11. The chip capacitors 8211 and 8311 and the short-circuit portions 827 and 837 may be respectively configured to adjust the impedance matching of the resonance mode of the first and the second antenna units 82 and 83. The coupling conductor line 44 has a plurality of bendings, which are configured to further reduce the size of the coupling conductor line 44. The first and the second low-pass filtering portions 822 and 832 also achieve a same function as that of the first and the second low-pass filtering portions 122 and 132 of the multi-band multi-antenna system 1 to reduce the dependent relationship between the lower and the higher operating bands of the first antenna unit 82 and the second antenna unit 83, and could effectively reduce overall sizes of the first and the second antenna units 82 and 83. Although the coupling conductor line 84 has a plurality of bendings, the first and the second coupling gaps 8412 and 8413 could also guide near field energy of the first and the second antenna units 82 and 83 to the coupling conductor line 44 to achieve the same effect as that of the coupling conductor line 14 of the multi-band multi-antenna system 1. Therefore, the coupling conductor line 44 could effectively enhance isolation of the lower operating bands of the first antenna unit 82 and the second antenna unit 83. Moreover, the grounding conductor line 15 may be configured as an isolation mechanism of the higher operating bands of the first antenna unit 82 and the second antenna unit 83, which may effectively enhance the isolation of the higher operating bands of the first antenna unit 82 and the second antenna unit 83. Therefore, the multi-band multi-antenna system 8 could also achieve the same effect as that of the multi-band multi-antenna system 1.

Figure 9:
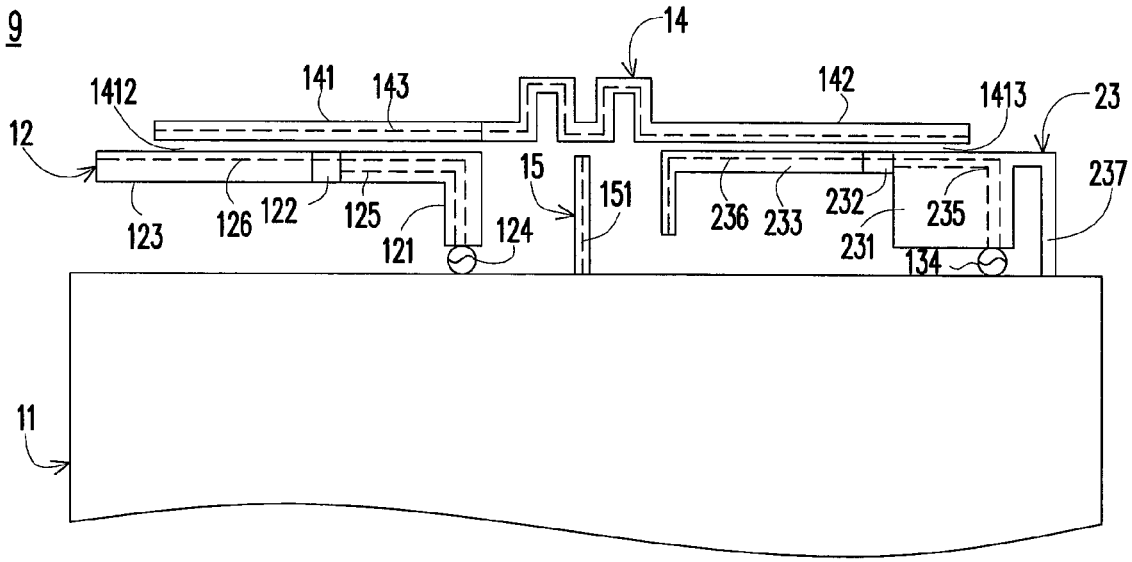
FIG. 9 is a structural schematic diagram of a multi-band multi-antenna system 9 according to an exemplary embodiment of the disclosure.

FIG. 9 is a structural schematic diagram of a multi-band multi-antenna system 9 according to an exemplary embodiment of the disclosure. Referring to FIG. 9, the multi-band multi-antenna system 9 includes the ground 11, the first antenna unit 12, the second antenna unit 23, the coupling conductor line 14 and the grounding conductor line 15. The first antenna unit 12 has the first signal source 124, the first conductor portion 121, the first low-pass filtering portion 122 and the first extending conductor portion 123. The first conductor portion 121 is coupled to the ground 11 through the first signal source 124. The first conductor portion 121 forms a first higher band resonance path 125 of the first antenna unit 12, and the first higher band resonance path 125 generates a first higher operating band. The first conductor portion 121, the first low-pass filtering portion 122 and the first extending conductor portion 123 form a first lower band resonance path 126 of the first antenna unit 12, and the first lower band resonance path 126 generates a first lower operating band. The first higher operating band and the first lower operating band are respectively configured to transmit or receive electromagnetic signals of at least one communication system band. The first low-pass filtering portion 122 may be, for example, a chip inductor, a low-pass filtering device, a circuit or a meandered thin conductor line.

The second antenna unit 23 has the second signal source 134, the second conductor portion 231, the second low-pass filtering portion 232 and the second extending conductor portion 233. The second conductor portion 231 is electrically coupled to the ground 11 through the second signal source 134. The second conductor portion 231 has the short-circuit portion 237 electrically coupled to the ground 11. The short-circuit portion 237 is used to adjust impedance matching of the resonance mode of the second antenna unit 23. The second conductor portion 231 forms a second higher band resonance path 235 of the second antenna unit 23, and the second higher band resonance path 235 generates a second higher operating band. The second conductor portion 231, the second low-pass filtering portion 232 and the second extending conductor portion 233 form a second lower band resonance path 236 of the second antenna unit 23, and the second lower band resonance path 236 generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band. The second low-pass filtering portion 232 may be, for example, a chip inductor, a low-pass filtering device, a circuit or a meandered thin conductor line.

The coupling conductor line 14 is disposed nearby the first antenna unit 12 and the second antenna unit 23, and has the first coupling portion 141 and the second coupling portion 142. The coupling conductor 14 has a plurality of bendings, which are configured to further reduce the size of the coupling conductor line 14. The first coupling portion 141 and the first antenna unit 12 have the first coupling gap 1412, and the second coupling portion 142 and the second antenna unit 23 have the second coupling gap 1413. The first coupling gap 1412 and the second coupling gap 1413 are all smaller than a two percent wavelength of a lowest operating frequency of a lowest communication system band commonly covered by the first and the second lower operating bands. A length of the path 143 of the coupling conductor line 14 is between a ⅓ wavelength and a ¾ wavelength of a center operating frequency of the lowest communication system band commonly covered by the first and second lower operating bands.

The grounding conductor line 15 is disposed between the first antenna unit 12 and the second antenna unit 23, and is electrically connected to the ground 11. A length of the path 151 of the grounding conductor line 15 is between a ⅙ wavelength and a ½ wavelength of the center operating frequency of the lowest communication system band commonly covered by the first and second higher operating bands.

In the multi-band multi-antenna system 9, the first and the second antenna units 12 and 23 are respectively different antenna types, and the coupling conductor line 14 has a plurality of bendings to further reduce the size of the coupling conductor line 14. However, the first and the second low-pass filtering portions 122 and 232 also achieve same functions as those of the first and the second low-pass filtering portions 122 and 132 of the multi-band multi-antenna system 1 to reduce the dependent relationship between the lower and the higher operating bands of the first antenna unit 12 and the second antenna unit 23, and effectively reduce an overall size of the first and the second antenna units 12 and 23. Although the coupling conductor line 14 has a plurality of bendings, the first and the second coupling gaps 1412 and 1413 could also guide near field energy of the first and the second antenna units 12 and 23 to the coupling conductor line 14 to achieve the same effect as that of the coupling conductor line 14 of the multi-band multi-antenna system 1. Therefore, the coupling conductor line 14 could effectively enhance isolation of the lower operating bands of the first antenna unit 12 and the second antenna unit 23. Moreover, the grounding conductor line 15 may be configured as an isolation mechanism of the higher operating bands of the first antenna unit 12 and the second antenna unit 23, which may effectively enhance the isolation of the higher operating bands of the first antenna unit 12 and the second antenna unit 23. Therefore, the multi-band multi-antenna system 9 could also achieve the same effect as that of the multi-band multi-antenna system 1.

Figure 10:
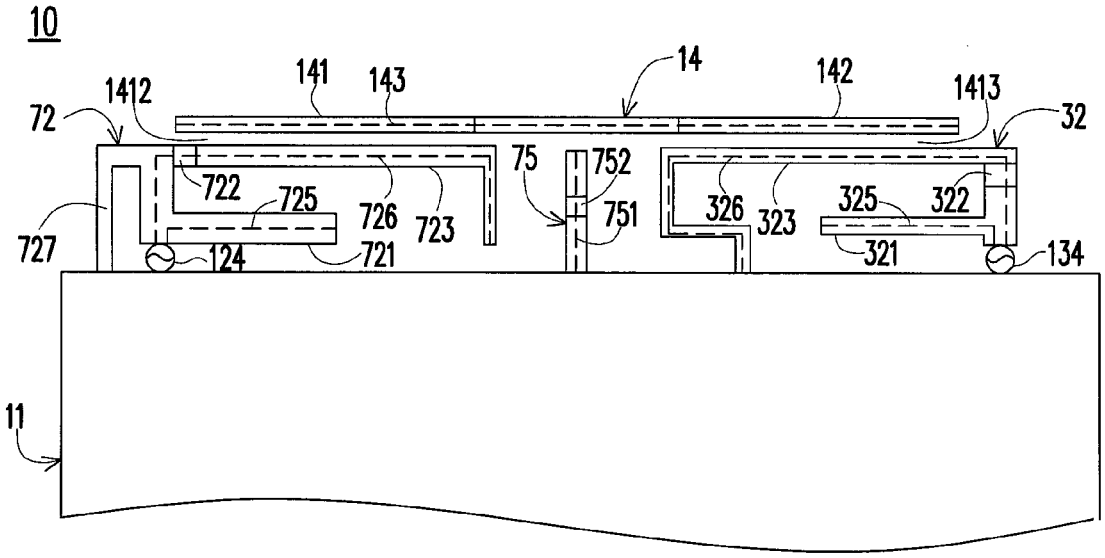
FIG. 10 is a structural schematic diagram of a multi-band multi-antenna system 10 according to an exemplary embodiment of the disclosure.

FIG. 10 is a structural schematic diagram of a multi-band multi-antenna system 10 according to an exemplary embodiment of the disclosure. Referring to FIG. 10, the multi-band multi-antenna system 10 includes the ground 11, the first antenna unit 72, the second antenna unit 32, the coupling conductor line 14 and the grounding conductor line 75. The first antenna unit 72 has the first signal source 124, the first conductor portion 721, the first low-pass filtering portion 722 and the first extending conductor portion 723. The first conductor portion 721 is electrically coupled to the ground 11 through the first signal source 124. The first conductor portion 721 has the short-circuit portion 727 electrically coupled to the ground 11. The short-circuit portion 727 is configured to adjust impedance matching of the resonance mode of the first antenna unit 72. The first conductor portion 721 forms the first higher band resonance path 725 of the first antenna unit 72, and the first higher band resonance path 725 generates a first higher operating band. The first conductor portion 721, the first low-pass filtering portion 722 and the first extending conductor portion 723 form the first lower band resonance path 726 of the first antenna unit 72, and the first lower band resonance path 726 generates a first lower operating band. The first higher operating band and the first lower operating band are respectively configured to transmit or receive electromagnetic signals of at least one communication system band. The first low-pass filtering portion 722 may be, for example, a chip inductor, a low-pass filtering device, a circuit or a meandered thin conductor line.

The second antenna unit 32 has the second signal source 134, the second conductor portion 321, the second low-pass filtering portion 322 and the second extending conductor portion 323. The second conductor portion 321 is electrically coupled to the ground 11 through the second signal source 134. The second conductor portion 321 forms the second higher band resonance path 325 of the second antenna unit 32, and the second higher band resonance path 325 generates a second higher operating band. One end of the second extending conductor portion 323 is electrically coupled to the ground 11. The second conductor portion 321, the second low-pass filtering portion 322 and the second extending conductor portion 323 form the second lower band resonance path 326 of the second antenna unit 32, and the second lower band resonance path 326 generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band. The second low-pass filtering portion 322 may be, for example, a chip inductor, a low-pass filtering device, a circuit or a meandered thin conductor line.

The coupling conductor line 14 is disposed nearby the first antenna unit 72 and the second antenna unit 73, and has the first coupling portion 141 and the second coupling portion 142. The first coupling portion 141 and the first antenna unit 72 have the first coupling gap 1412, and the second coupling portion 142 and the second antenna unit 73 have the second coupling gap 1413. The first coupling gap 1412 and the second coupling gap 1413 are all smaller than a two percent wavelength of a lowest operating frequency of a lowest communication system band commonly covered by the first and the second lower operating bands. A length of the path 143 of the coupling conductor line 14 is between a ⅓ wavelength and a ¾ wavelength of a center operating frequency of the lowest communication system band commonly covered by the first and second lower operating bands.

The grounding conductor line 75 is disposed between the first antenna unit 72 and the second antenna unit 32, and is electrically connected to the ground 11. The grounding conductor line 75 has a chip inductor 752, which is configured for further reducing a size of the grounding conductor line 75. The chip inductor 752 may be replaced by a chip capacitor, a filtering device, a circuit or a plurality of bendings. A length of a path 751 of the grounding conductor line 75 is between a ⅙ wavelength and a ½ wavelength of the center operating frequency of the lowest communication system band commonly covered by the first and second higher operating bands.

In the multi-band multi-antenna system 10, the first and the second antenna units 72 and 73 are respectively different antenna types, and the grounding conductor line 75 has the chip inductor 752 to further reduce the size of the grounding conductor line 75. The first and the second low-pass filtering portions 722 and 322 also achieve the same effects as those of the first and the second low-pass filtering portions 122 and 132 of the multi-band multi-antenna system 1 to decrease the dependent relationship between the lower and the higher operating bands of the first antenna unit 72 and the second antenna unit 32, and could effectively reduce overall sizes of the first and the second antenna units 72 and 32. The first and the second coupling gaps 1412 and 1413 could also guide near field energy of the first and the second antenna units 72 and 32 to the coupling conductor line 14 to achieve the same function as that of the coupling conductor line 14 of the multi-band multi-antenna system 1. Therefore, the coupling conductor line 14 could effectively enhance isolation of the lower operating bands of the first antenna unit 72 and the second antenna unit 32. Although the grounding conductor line 75 has the chip inductor 752, it could be also configured as an isolation mechanism of the higher operating bands of the first antenna unit 72 and the second antenna unit 32, which could effectively enhance the isolation of the higher operating bands of the first antenna unit 72 and the second antenna unit 32. Therefore, the multi-band multi-antenna system 10 could also achieve the same function as that of the multi-band multi-antenna system 1.

Figure 11A:
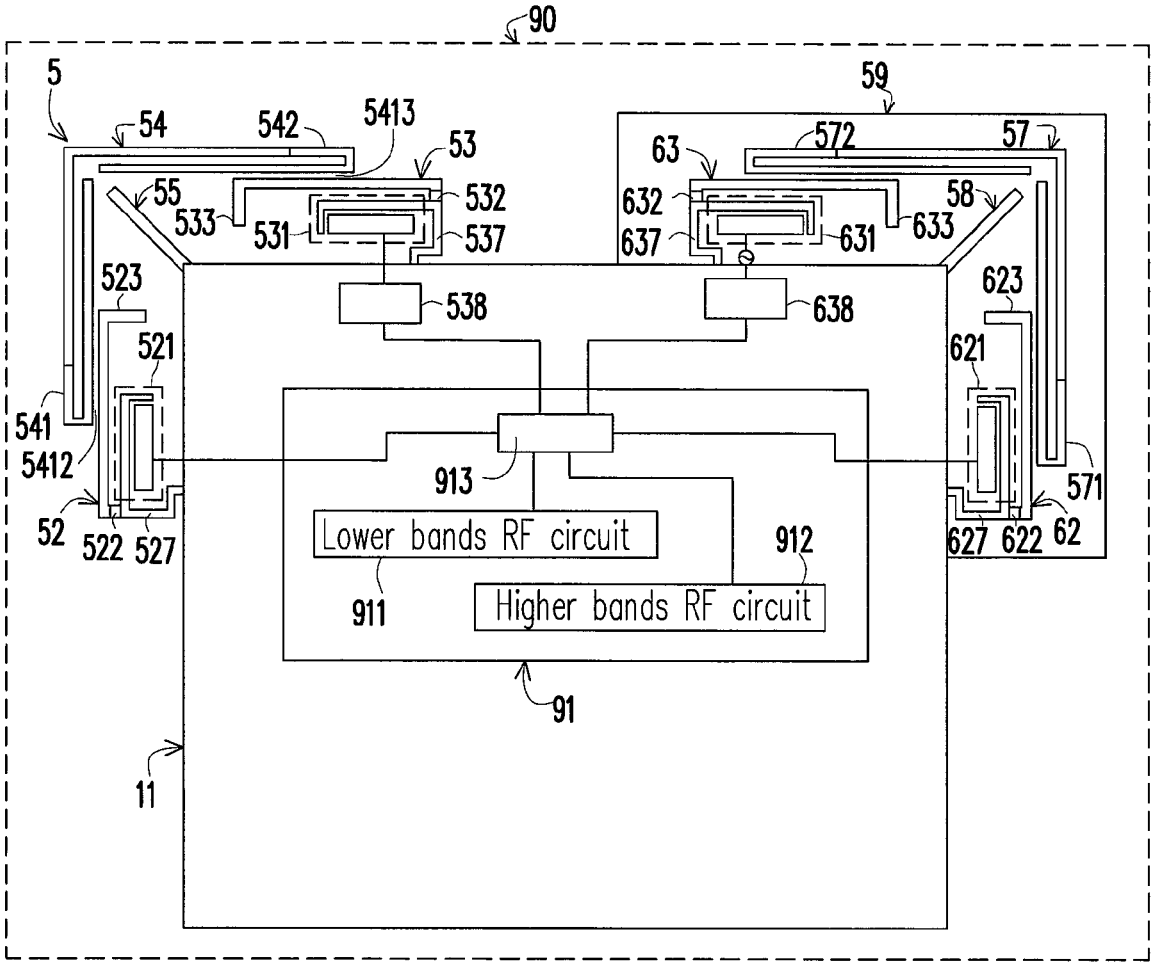
FIG. 11A is a functional schematic diagram of a communication device 90 according to another exemplary embodiment of the disclosure.

FIG. 11A is a functional schematic diagram of a communication device 90 according to another exemplary embodiment of the disclosure. The communication device 90 includes at least one multi-band transceiver 91 and a multi-band multi-antenna system 5. The multi-band transceiver 91 serves as a signal source and is disposed on the ground 11. The multi-band multi-antenna system 5 is electrically coupled to the multi-band transceiver 91, and includes the first antenna unit 52, the second antenna unit 53, the coupling conductor line 54 and the grounding conductor line 55. The first antenna unit 52 has the first conductor portion 521, the first low-pass filtering portion 522 and the first extending conductor portion 523. The first low-pass filtering portion 522 is electrically coupled between the first conductor portion 521 and the first extending conductor portion 523, and the first conductor portion 521 is electrically coupled to the multi-band transceiver 91. The first conductor portion 521 forms a first higher band resonance, path of the first antenna unit 52, and the first higher band resonance path generates a first higher operating band. The first conductor portion 521, the first low-pass filtering portion 522 and the first extending conductor portion 523 form a first lower band resonance path of the first antenna unit 52, and the first lower band resonance path generates a first lower operating band. The first higher operating band and the first lower operating band are respectively configured to transmit or receive electromagnetic signals of at least one communication system band. The second antenna unit 53 has the second conductor portion 531, the second low-pass filtering portion 532 and the second extending conductor portion 533. The second low-pass filtering portion 532 is electrically coupled between the second conductor portion 531 and the second extending conductor portion 533, and the second conductor portion 531 is electrically coupled to the multi-band transceiver 91.

The second conductor portion 531 forms a second higher band resonance path of the second antenna unit 53, and the second higher band resonance path generates a second higher operating band. The second conductor portion 531, the second low-pass filtering portion 532 and the second extending conductor portion 533 form a second lower band resonance path of the second antenna unit 53, and the second lower band resonance path generates a second lower operating band. The second higher operating band and the second lower operating band are respectively configured to transmit or receive electromagnetic signals of at least one communication system band. The first and second lower operating bands cover at least one same communication system band, and the first and second higher operating bands cover at least one same communication system band.

The coupling conductor line 54 is disposed nearby the first antenna unit 52 and the second antenna unit 53, and has the first coupling portion 541 and the second coupling portion 542. The first coupling portion 541 and the first antenna unit 52 have the first coupling gap 5412, and the second coupling portion 542 and the second antenna unit 53 have the second coupling gap 5413. The grounding conductor line 55 is disposed between the first antenna unit 52 and the second antenna unit 53, and is electrically coupled to the ground 11.

In the multi-band multi-antenna system 5, the first and the second antenna units 52 and 53 are respectively disposed at two adjacent edges of a corner of the ground 11. The first and the second antenna units 52 and 53, the coupling conductor line 54 and the grounding conductor line 55 are formed on a surface of a dielectric substrate or formed on a surface of a casing of the communication device 90 through a printing or etching process. The first conductor portion 521 and the second conductor portion 531 respectively have a coupling gap. The first conductor portion 521 and the second conductor portion 531 are respectively coupled to the ground 11 through the short-circuit portion 527 and the short-circuit portion 537. The coupling gaps and the short-circuit portions 527 and 537 are all configured to adjust impedance matching of the resonance mode of the first and the second antenna units 52 and 53. The first and the second low-pass filtering portions 522 and 532 also have the same effect as that of the first and the second low-pass filtering portions 122 and 132 of the multi-band multi-antenna system 1, which may mitigate the dependent relationship between the lower and the higher operating bands of the first antenna unit 52 and the second antenna unit 53, and effectively reduce an overall size of the first and the second antenna units 52 and 53. Although the coupling conductor line 54 has a plurality of bendings, the first and the second coupling gaps 5412 and 5413 can also guide near field energy of the first and the second antenna units 52 and 53 to the coupling conductor line 54 to achieve the same effect as that of the coupling conductor line 14 of the multi-band multi-antenna system 1. Therefore, the coupling conductor line 54 can effectively enhance isolation of the lower operating bands of the first antenna unit 52 and the second antenna unit 53. Moreover, the grounding conductor line 55 may be configured as an isolation mechanism of the higher operating bands of the first antenna unit 52 and the second antenna unit 53, which may effectively enhance the isolation of the higher operating bands of the first antenna unit 52 and the second antenna unit 53. Therefore, the multi-band multi-antenna system 5 can also achieve the same effect as that of the multi-band multi-antenna system 1.

In the present embodiment, the multi-band transceiver 91 serves as the signal source, and has at least one lower band radio frequency (RF) circuit 911 and at least one higher bands RF circuit 912. The lower bands RF circuit 911 and the higher bands RF circuit 912 may be electrically coupled to the first conductor portion 521 or the second conductor portion 531 through a switch circuit 913. A matching circuit, a switch, a chip capacitor, a chip inductor or a filter circuit may be coupled between the multi-band transceiver 91 and the first and second antenna units 52 and 53. For example, in the communication device 90 of the present embodiment, a matching circuit 538 is coupled between the multi-band transceiver 91 and the second antenna unit 53.

As shown in FIG. 11A, in a practical application, a plurality of multi-band multi-antenna systems 5 may be disposed or implemented in the communication device 90 of the disclosure, and the multi-band multi-antenna systems 5 may also be replaced by the structures disclosed in the exemplary embodiments of FIG. 1, FIG. 2, FIG. 3, FIG. 4, FIG. 7, FIG. 8, FIG. 9 and FIG. 10 to achieve the same effect, so as to achieve a multi-band MIMO or a pattern switchable or beam-steering multi-antenna system operation.

Figure 11B:
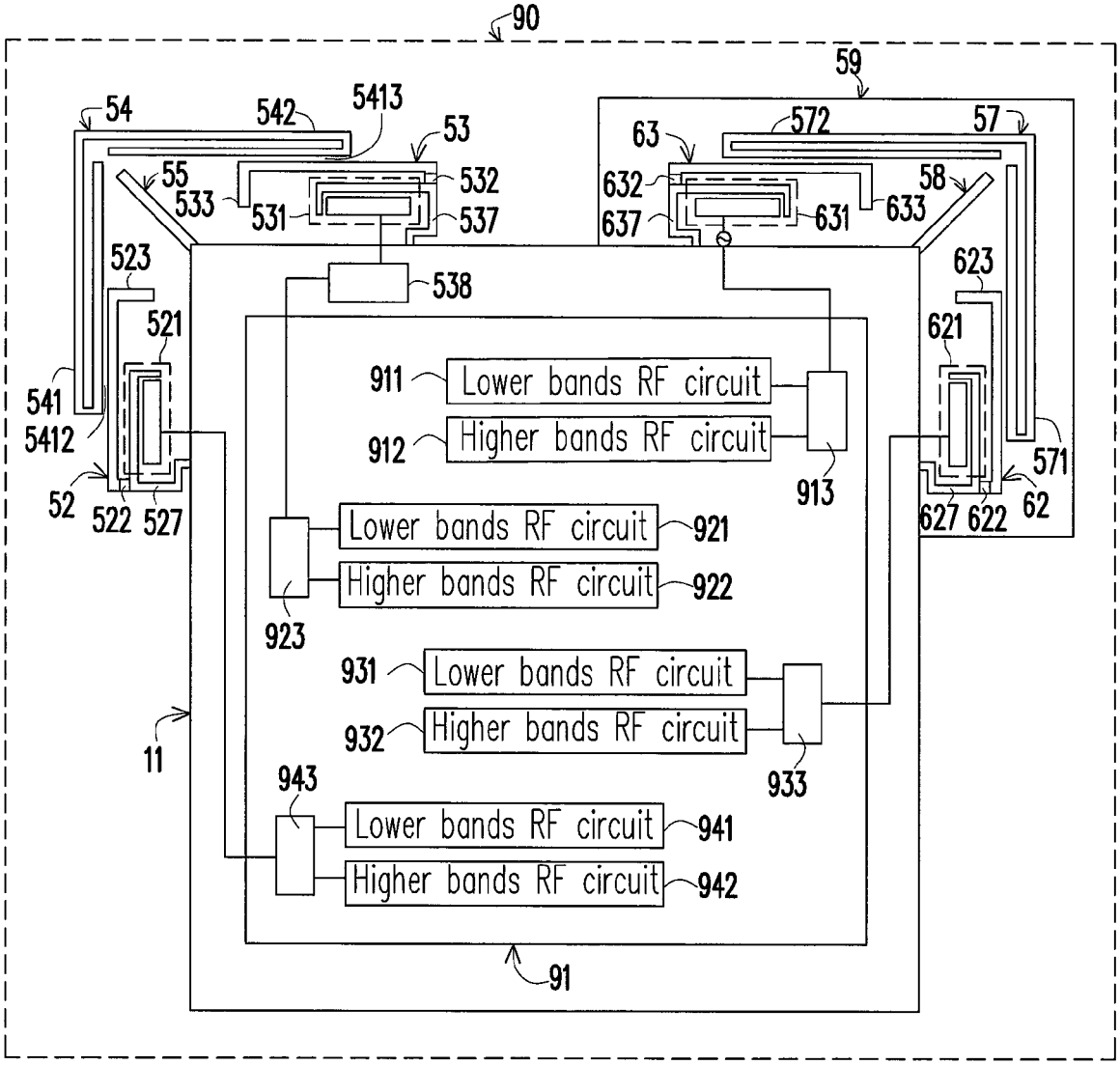
FIG. 11B is a functional schematic diagram of a communication device 90 according to another exemplary embodiment of the disclosure.

FIG. 11B is a functional schematic diagram of a communication device 90 according to another exemplary embodiment of the disclosure. The multi-band transceiver 91 has a plurality of lower bands RF circuits 911, 921, 931 and 941 and a plurality of higher bands RF circuits 912, 922, 932 and 942. In the exemplary embodiment of FIG. 11B, the lower bands RF circuit 911 and the higher bands RF circuit 912 are electrically coupled to a second antenna unit 63 of a multi-band multi-antenna system through a switch or matching circuit 913. The lower bands RF circuit 921 and the higher bands RF circuit 922 are electrically coupled to a second antenna unit 53 of another multi-band multi-antenna system through a switch or matching circuit 923. The lower bands RF circuit 931 and the higher bands RF circuit 932 are electrically coupled to a first antenna unit 62 of the multi-band multi-antenna system through a switch or matching circuit 933. The lower bands RF circuit 941 and the higher bands RF circuit 942 are electrically coupled to a first antenna unit 52 of the other multi-band multi-antenna system through a switch or matching circuit 943.

As shown in FIG. 11B, in a practical application, a plurality of multi-band multi-antenna systems may be disposed or implemented in the communication device 90 of the disclosure, and the multi-band multi-antenna systems can also be replaced by the structures disclosed in the exemplary embodiments of FIG. 1, FIG. 2, FIG. 3, FIG. 4, FIG. 5A, FIG. 7, FIG. 8, FIG. 9 and FIG. 10 to achieve the same effect, so as to achieve a multi-band MIMO or a pattern switchable or beam-steering multi-antenna system operation.

In other embodiments of the disclosure, the communication device 90 may include other devices (which are not shown in FIG. 11B), for example, a filter, a frequency converting unit, an amplifier, an analog-to-digital converter, a digital-to-analog-converter, a modulator, a demodulator and a digital signal processor, etc. The transceiver module 91 can perform signal processing such as signal amplification, filtering, frequency conversion or demodulation, or so like. on the transmitted or received electromagnetic signal of at least one communication band. However, the present disclosure focuses on the technical structure of the multi-band multi-antenna system, so that the other components of the communication device 90 are not described in detail.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A multi-band multi-antenna system, comprising: a ground;

a first antenna unit, having a first conductor portion, a first low-pass filtering portion and a first extending conductor portion, wherein the first conductor portion is electrically coupled to the ground through a first signal source, and the first low-pass filtering portion is electrically coupled between the first conductor portion and the first extending conductor portion, the first conductor portion forms at least one first higher band resonance path of the first antenna unit, and the first higher band resonance path generates at least one first higher operating band, the first conductor portion, the first low-pass filtering portion and the first extending conductor portion form at least one first lower band resonance path of the first antenna unit, and the first lower band resonance path generates at least one first lower operating band, and the first higher and the first lower operating bands are respectively configured to transmit or receive electromagnetic signals of at least one communication system band, and the first low-pass filtering portion suppresses higher-modes of the first lower band resonance;

a second antenna unit, having a second conductor portion, a second low-pass filtering portion and a second extending conductor portion, wherein the second conductor portion is electrically coupled to the ground through a second signal source, and the second low-pass filtering portion is electrically coupled between the second conductor portion and the second extending conductor portion, the second conductor portion forms at least one second higher band resonance path of the second antenna unit, and the second higher band resonance path generates at least one second higher operating band, the second conductor portion, the second low-pass filtering portion and the second extending conductor portion form at least one second lower band resonance path of the second antenna unit, and the second lower band resonance path generates at least one second lower operating band, the second higher and the second lower operating bands are respectively configured to transmit or receive electromagnetic signals of at least one communication system band, the first lower and the second lower operating bands cover at least one same communication system band, and the first higher and the second higher operating bands cover at least one same communication system band, and the second low-pass filtering portion suppresses higher-modes of the second lower band resonance path;

a coupling conductor line, disposed nearby the first antenna unit and the second antelma unit, and having at least one first coupling portion and a second coupling portion, wherein there is a first coupling gap between the first coupling portion and the first antenna unit, and there is a second coupling gap between the second coupling portion and the second antenna unit; and a grounding conductor line, disposed between the first antenna unit and the second antenna unit, and electrically connected to the ground, wherein a length of the coupling conductor line is between a ⅓ wavelength and a ¾ wavelength of a center operating frequency of a lowest communication system band commonly covered by the first and second lower operating bands, and a length of the grounding conductor line is between a ⅙ wavelength and a ½ wavelength of the center operating frequency of the lowest communication system band commonly covered by the first and second higher operating bands, wherein the first antenna unit, the grounding conductor line and the second antenna unit are sequentially disposed along at least one edge of the ground, wherein the coupling conductor line is disposed along at least one direction, wherein the first antenna unit, the grounding conductor line and the second antenna unit are disposed between the ground and the coupling conductor line, and wherein the coupling conductor line and the grounding conductor line are configured to provide isolation of the lower and higher operating bands of the first and second antenna units, respectively.

2. The multi-band multi-antenna system of claim 1, wherein the first and the second coupling gaps are all smaller than a 1/50 wavelength of a lowest operating frequency of a lowest communication system band commonly covered by the first and the second lower operating bands.

3. The multi-band multi-antenna system of claim 1, wherein the first or the second conductor portion is electrically coupled to the ground through a short-circuit portion.

4. The multi-band multi-antenna system of claim 1, wherein the first or the second conductor portion has at least one coupling gap.

5. The multi-band multi-antenna system of claim 4, wherein each coupling gap is smaller than a 1/50 wavelength of a lowest operating frequency of a lowest communication system band commonly covered by the first and the second lower operating bands.

6. The multi-band multi-antenna system of claim 1, wherein the low-pass filtering portion is a chip inductor, a low-pass filtering device, a low-pass filtering circuit or a meandered thin conductor line.

7. The multi-band multi-antenna system of claim 1, wherein the coupling conductor line or the grounding conductor line has a chip inductor, a capacitor, a filtering device, a circuit or a plurality of bendings.

8. The multi-band multi-antenna system of claim 1, wherein the first or the second conductor portions has a chip capacitor or a matching circuit.

9. The multi-band multi-antenna system of claim 1, wherein the first or the second extending conductor portion is electrically coupled to the ground.

10. The multi-band multi-antenna system as claimed in claim 1, wherein a chip inductor, a chip capacitor, a matching circuit or a switch circuit is coupled between the first conductor portion and first signal source or between the second conductor portion and second signal source.

11. A communication device, comprising:

a multi-band transceiver, configured as a signal source, and located on a ground; and a multi-band multi-antenna system, electrically coupled to the multi-band transceiver, and comprising:

a first antenna unit, having a first conductor portion, a first low-pass filtering portion and a first extending conductor portion, wherein the first low-pass filtering portion is electrically coupled between the first conductor portion and the first extending conductor portion, and the first conductor portion is electrically coupled to the multi-band transceiver, the first conductor portion forms at least one first higher band resonance path of the first antenna unit, and the first higher band resonance path generates at least one first higher operating band, the first conductor portion, the first low-pass filtering portion and the first extending conductor portion form at least one first lower band resonance path of the first antenna unit, and the first lower band resonance path generates at least one first lower operating band, and the first higher and the first lower operating bands are respectively configured to transmit or receive electromagnetic signals of at least one communication system band, and the first low-pass filtering portion suppresses higher-modes of the first lower band resonance path;

a second antenna unit, having a second conductor portion, a second low-pass filtering portion and a second extending conductor portion, wherein the second low-pass filtering portion is electrically coupled between the second conductor portion and the second extending conductor portion, and the second conductor portion is electrically coupled to the multi-band transceiver, the second conductor portion forms at least one second higher band resonance path of the second antenna unit, and the second higher band resonance path generates at least one second higher operating band, the second conductor portion, the second low-pass filtering portion and the second extending conductor portion form at least one second lower band resonance path of the second antenna unit, and the second lower band resonance path generates at least one second lower operating band, the second higher and the second lower operating bands are respectively configured to transmit or receive electromagnetic signals of at least one communication system band, the first lower and the second lower operating bands cover at least one same communication system band, and the first higher and the second higher operating bands cover at least one same communication system band, and the second low-pass filtering portion suppresses higher-modes of the second lower band resonance;

a coupling conductor line, disposed nearby the first antenna unit and the second antenna unit, and having at least one first coupling portion and a second coupling portion, wherein there is a first coupling gap between the first coupling portion and the first antenna unit, and there is a second coupling gap between the second coupling portion and the second antenna unit; and a grounding conductor line, disposed between the first antenna unit and the second antenna unit, and electrically connected to the ground, wherein a length of the coupling conductor line is between a ⅓ wavelength and a ¾ wavelength of a center operating frequency of a lowest communication system band commonly covered by the first and second lower operating bands, and a length of the grounding conductor line is between a ⅙ wavelength and a ½ wavelength of the center operating frequency of the lowest communication system band commonly covered by the first and second higher operating bands, wherein the first antenna unit, the grounding conductor line and the second antenna unit are sequentially disposed along at least one edge of the ground, wherein the coupling conductor line is disposed along at least one direction, wherein the first antenna unit, the grounding conductor line and the second antenna unit are disposed between the ground and the coupling conductor line, and wherein the coupling conductor line and the grounding conductor line are configured to provide isolation of the lower and higher operating bands of the first and second antenna units, respectively.

12. The communication device of claim 11, wherein the first and the second coupling gaps are all smaller than a 1/50 wavelength of a lowest operating frequency of a lowest communication system band commonly covered by the first and the second lower operating bands.

13. The communication device of claim 11, wherein the first or the second conductor portion is electrically coupled to the ground through a short-circuit portion.

14. The communication device of claim 11, wherein the first or the second conductor portion has at least one coupling gap.

15. The communication device of claim 14, wherein each coupling gap is smaller than a 1/50 wavelength of a lowest operating frequency of a lowest communication system band commonly covered by the first and the second lower operating bands.

16. The communication device of claim 11, wherein the low-pass filtering portion is a chip inductor, a low-pass filtering device, a low-pass filtering circuit or a meandered thin conductor line.

17. The communication device of claim 11, wherein the coupling conductor line or the grounding conductor line has a chip inductor, a capacitor, a filtering device, an electric circuit or a plurality of bendings.

18. The communication device of claim 11, wherein the first or the second conductor portions has a chip capacitor or a matching circuit.

19. The communication device of claim 11, wherein the first or the second extending conductor portion is electrically coupled to the ground.

20. The communication device of claim 11, wherein the multi-band transceiver has at least one lower band radio frequency circuit and at least one higher band radio frequency circuit.

21. The communication device of claim 11, wherein a matching circuit, a switch, a chip capacitor, a chip inductor or a filter circuit is coupled between the multi-band transceiver and the first and the second antenna units.

* * * * *